US010465476B2

(12) United States Patent
Murray et al.

(10) Patent No.: US 10,465,476 B2
(45) Date of Patent: Nov. 5, 2019

(54) SUPPORT DEVICE FOR USE IN A WELLBORE AND A METHOD FOR DEPLOYING A BARRIER IN A WELLBORE

(71) Applicant: SMJM LIMITED, Aberdeen (GB)

(72) Inventors: John Kenneth Fraser Murray, Aberdeen (GB); John Fraser, Dundee (GB); Jason Fong, Aberdeen (GB)

(73) Assignee: Coretrax Technology Limited, Aberdeen (GB)

( * ) Notice: Subject to any disclaimer, the term of this patent is extended or adjusted under 35 U.S.C. 154(b) by 549 days.

(21) Appl. No.: 15/033,675

(22) PCT Filed: Nov. 7, 2014

(86) PCT No.: PCT/GB2014/053317

§ 371 (c)(1),
(2) Date: May 2, 2016

(87) PCT Pub. No.: WO2015/071644

PCT Pub. Date: May 21, 2015

(65) Prior Publication Data

US 2016/0251938 A1 Sep. 1, 2016

(30) Foreign Application Priority Data

Nov. 14, 2013 (GB) ..... 1320104.1

(51) Int. Cl.
*E21B 34/10* (2006.01)
*E21B 19/16* (2006.01)
(Continued)

(52) U.S. Cl.
CPC ..... *E21B 34/10* (2013.01); *E21B 17/02* (2013.01); *E21B 19/16* (2013.01); *E21B 23/06* (2013.01);
(Continued)

(58) Field of Classification Search
CPC ..... E21B 33/127; E21B 33/1277; E21B 33/1272; E21B 33/1275; E21B 17/02; E21B 17/021; E21B 19/16
(Continued)

(56) References Cited

U.S. PATENT DOCUMENTS 2,656,891 A * 10/1953 Toelke ..... E21B 33/1204 166/122
2,831,540 A * 4/1958 Huber ..... E21B 23/06 166/122

(Continued)

FOREIGN PATENT DOCUMENTS

| | | | |
|---|---|---|---|
| EP | 0496540 | A1 | 7/1992 |
| WO | 2007075855 | A2 | 7/2007 |
| WO | 2012160380 | A1 | 11/2012 |

OTHER PUBLICATIONS

PCT Search Report (PCT/GB2014/053317), dated Nov. 3, 2015.

*Primary Examiner* — Blake E Michener
(74) *Attorney, Agent, or Firm* — Gregory L. Porter; Hunton Andrews Kurth LLP

(57) ABSTRACT

A downhole support device for use in a wellbore is provided, where the device (200) is adapted to be run into the wellbore (202) through or on a workstring (204). The device (200) comprises an inflatable element (206) adapted to be selectively connectable to the workstring (204). The inflatable element (206) selectively applies a biasing force to an external structure such, for example, a wall (214) of the wellbore (202) when in an inflated state. The inflatable element (206) has an inlet (208) for receiving and being inflated by a flowing substance. The device (200) also comprises an inflation mechanism (210) and a disconnect mechanism (222) adapted to be selectively disconnectable from the workstring (204). A method of deploying a barrier in a wellbore which makes use of the support device is also provided.

26 Claims, 15 Drawing Sheets

(51) Int. Cl.

| | |
|---|---|
| ***E21B 17/02*** | (2006.01) |
| ***E21B 23/06*** | (2006.01) |
| ***E21B 33/127*** | (2006.01) |
| ***E21B 33/134*** | (2006.01) |
| ***E21B 34/00*** | (2006.01) |

(52) U.S. Cl.
CPC ..... *E21B 33/127* (2013.01); *E21B 33/134* (2013.01); *E21B 2034/007* (2013.01)

(58) Field of Classification Search
USPC ..... 166/242.6
See application file for complete search history.

(56) References Cited

U.S. PATENT DOCUMENTS 2,942,666 A * 6/1960 Boer ..... E21B 33/127 166/120
2,978,029 A * 4/1961 True ..... E21B 23/065 166/117
3,581,816 A * 6/1971 Malone ..... E21B 33/127 166/187
3,995,694 A * 12/1976 Freiburger ..... E21B 33/127 166/285
4,869,324 A 9/1989 Holder
4,962,812 A * 10/1990 Berzin ..... E21B 33/127 166/187
5,205,358 A * 4/1993 Mitzlaff ..... E21B 33/127 166/187
5,236,201 A * 8/1993 Vance, Sr. ..... E21B 33/1277 166/187
5,242,019 A * 9/1993 Benker ..... E21B 33/1277 166/187
5,271,469 A * 12/1993 Brooks ..... E21B 33/127 166/187
5,343,956 A 9/1994 Coronado
5,411,083 A * 5/1995 Freiburger ..... E21B 17/06 166/187
5,967,229 A * 10/1999 Basso ..... E21B 23/06 166/187
6,050,336 A * 4/2000 Willauer ..... E21B 23/06 166/117
6,341,654 B1 * 1/2002 Wilson ..... E21B 27/02 166/106
6,736,214 B2 * 5/2004 Hoffman ..... E21B 23/04 166/120
9,322,241 B2 * 4/2016 Saltel ..... E21B 33/1204
9,422,787 B2 * 8/2016 Fraser ..... E21B 23/06
2009/0183875 A1 * 7/2009 Rayssiguier ..... E21B 33/1277 166/290
2010/0243234 A1 * 9/2010 Saltel ..... E21B 23/06 166/101
2011/0017472 A1 * 1/2011 Maxwell ..... E21B 33/127 166/380
2013/0105158 A1 * 5/2013 Saltel ..... E21B 33/1204 166/290
2014/0216755 A1 * 8/2014 Hallundae ..... E21B 23/06 166/373
2014/0238694 A1 * 8/2014 Fraser ..... E21B 23/06 166/382

* cited by examiner

SUPPORT DEVICE FOR USE IN A WELLBORE AND A METHOD FOR DEPLOYING A BARRIER IN A WELLBORE

FIELD OF THE INVENTION

The present invention relates to blocking wellbores using compound plugs (such as, for example, cement plugs), and in particular to a support device for providing a barrier which assists the formation of wellbore compound plugs or a wellbore casing compound plugs. The present invention further relates to a corresponding method for deploying a barrier in a wellbore.

BACKGROUND OF THE INVENTION

Hydrocarbons such as oil and gas are usually recovered from a subterranean formation using wellbores drilled into the formation. During the life of a well, it may be necessary to set a plug for sidetracking, lost-circulation control, zone isolation and/or well abandonment purposes.

Zonal isolation may be necessary in many wells and is achieved when securing a casing string inside a section of the wellbore typically by pumping cement into the annular space defined by the inner surface of the wellbore wall and the outer surface of the casing string.

Well abandonment is usually considered when a well reaches its economic limit and becomes a financial liability. In this process, production tubing is removed from the cased wellbore and sections of the wellbore are generally sealed off with a cement plug (which may be many metres in height) to plug the wellbore at that location and therefore isolate the potential flow path between the various gas or oil and water zones from each other, as well as the surface.

Both procedures require some kind of barrier or support device placed inside the wellbore either temporarily or permanently, but with sufficient strength to withstand the pushing/pumping force provided by the weight of the cement placed on top of the support device.

Similarly, when cementing a casing in place in, for example, a gas cavern, salt cavern, coal bed, methane well etc., it is desirable to provide a reliable and cost effective support structure that can be easily installed and removed.

In a particular example for abandoning or suspending a well, the so called plug cementing is an essential operation performed in accordance with regulatory guidelines under a variety of well conditions. Safety regulations require between 150 m and 300 m of a column of cement to be provided in the area to be abandoned or suspended. The column of cement is typically delivered into the wellbore via a drillstring (i.e. a string of drill pipe such as OCTG tubulars). In order to prevent slumping of the heavier cement into the well fluid below the plug, a physical barrier is used to hold the cement in place while the cement hardens to form a plug.

FIG. 1 discloses an example of a known cement support tool (Perigon CST™ tool) 1 that is delivered to a location within the wellbore 3 via a drill pipe string 2. During delivery, the cement support tool 1 is folded together like an umbrella stored inside a transport tube 4 before it is pushed into the drill pipe string 2 using a push rod 5. The cement support tool 1 is then pushed through the drill pipe string 2 by the following cement 6 until it leaves the lower most end of the drill pipe string 2 at which point it unfolds and contacts the wellbore walls 7. In the unfolded state, a membrane 8 of the cement support tool 1 fills the inner diameter of the wellbore 3 helping to prevent wellbore fluid below the cement support tool 1 from mixing with the cement 6 that is pumped down the drill pipe string 2 into the wellbore 3.

However, the cement support tool 1 described above does not provide a particularly strong barrier due to the limited gripping force that can be provided by the unfolded wire arrangement, so that not much cement weight can be put on top of the cement support tool 1 before it moves. Additionally, cement is delivered into the wellbore after the installation of the support tool 1 resulting in major time losses.

FIG. 2 illustrates an improvement over the above described device and as disclosed in WO2012/160380. An improved device 100 of WO2012/160380 comprises an inflatable elastomeric element 102 adapted to expand into a substantially cylindrical shape when inflated with a fluid to block the wellbore 120 and to retain itself in the position blocking the wellbore 120. The inflatable element 102 is delivered to a distal end of a string 106 by being pumped along an inner bore of the string 106 by the same fluid (cement slurry 124) which will be used for plugging the wellbore 120. Once positioned at the distal end of the string 106, the inflatable element 102 is inflated with the slurry 124. The inflatable element 102 has a pressure sensitive resiliently deformable disconnect member 108 for detaching the inflatable element 102 from the string 106 once the inflatable element 102 has expanded sufficiently to block the wellbore 120 and to retain itself in the position blocking the wellbore 120. The disconnect member 108 is retained within an inner bore of the string 106 while the inflatable element 102 is being inflated. The disconnect member 108 deforms when the pressure acting on the disconnect member 108 exceeds a predetermined pressure, which is not less than the pressure needed to expand the inflatable element 102 to block the wellbore 120 (as shown in phantom lines in FIG. 2), and passes through an outlet 126 at the distal end of the string 106 thereby disconnecting the inflatable element 102 from the string 106. The inflatable element 102 has annular ribs 112 provided around its outer circumference for gripping and sealing against a wellbore wall 122. After the inflatable element has detached from the string 106 into the position blocking the wellbore 120, the cement slurry 124 is continued to be pumped through and out of the string 106 into the wellbore above the inflatable element 102. At the same time the string 106 begins to be gradually pulled out of the wellbore 120 at an appropriate speed so that a required length of the wellbore 120 becomes filled with the slurry. The slurry is then allowed to harden and thus a secure plug inside the wellbore 120 formed. In this arrangement, delivery and installation of the support device 100 and pumping cement slurry 124 down the well bore are carried out simultaneously.

Although providing an improvement over the pre-existing devices, the device of WO2012/160380 has a relatively low reliability because of the relatively high rate of failure of the device during deployment.

Accordingly, it is an object of the present invention to obviate and/or mitigate the above disadvantages of the prior art and to provide an improved support device for use in a wellbore, the device having improved support strength and sealing properties, higher reliability and cost efficiency than prior art support devices. A further object of the present invention is to provide an improved method for deploying a support device in a wellbore.

SUMMARY OF THE INVENTION

According to a first aspect of the present invention, there is provided a downhole support device for use in a wellbore and adapted to be run into the wellbore through or on a workstring of tubulars, the downhole support device comprising:

an inflatable element adapted to be selectively connectable to the workstring and to apply a biasing force to an external structure (which may be a wellbore wall, including that of casing, liner, open hole, etc.) in an inflated state, the inflatable element having an inlet for receiving and being inflated by a flowing substance (e.g. such as fluid, fluidized solids, granular and powdery matters);

an inflation mechanism; and a disconnect mechanism adapted to be selectively disconnectable from the workstring.

Hereinafter, for the sake of brevity, the term "fluid" will be used in the present application both for denoting a dedicated well fluid as well as other flowing substances, including other fluids and/or fluidized solids granular and powdery matters.

Preferably, the inflation mechanism comprises an inflation valve arrangement preferably at or in fluid communication with the inlet of the inflatable element, the inflation valve arrangement comprising an actuation means adapted to actuate the inflation valve arrangement at a predetermined pressure acting on the inflation valve arrangement to enable inflation of the inflatable element.

Preferably, the inflation valve arrangement further comprises a locking mechanism keeping the inflation valve arrangement shut until the predetermined pressure has been reached. Preferably, the predetermined fluid pressure for actuating the inflation valve arrangement to enable inflation of the inflatable element is greater than a force of the locking mechanism keeping the inflation valve arrangement shut.

Preferably, the inflation valve arrangement comprises at least one moving element and preferably, the locking mechanism comprises a biasing means arranged to bias the moving element of the inflation valve arrangement into a first position blocking a fluid passageway through the inflation valve arrangement into the inflatable element. The biasing means is preferably arranged so that its force can be overcome by increasing the pressure of the fluid acting on the inflation valve arrangement so that the moving element is moved into a second position in which the fluid passageway through the inflation valve arrangement into the inflatable element is open. The biasing means preferably biases the inflation valve arrangement and more preferably the said moving element into a shut position or more preferably into the said first blocking position during delivery of the support device through the string.

Preferably, the actuation means is configured to releasably engage a wall of an inner bore of an external structure (e.g. workstring, casing, liner or an inner surface of an open hole etc.) whilst being biased by the bias means into the shut position thereby keeping the inflatable element connected with the external structure before the inflatable element is inflated and can support itself in the wellbore. Preferably, at the same time, the actuation means is configured to be activated by the external structure when the predetermined pressure has been exceeded whereby the force acting from the external structure on the actuation means causes relative displacement of the moving element into the second position in which the fluid passageway through the inflation valve arrangement into the inflatable element is open. In a preferred arrangement, the actuation means is configured to releasably engage a wall of an inner bore of the string by means of which the support device is delivered downhole.

Preferably, the moving element of the inflation valve arrangement comprises a sliding valve which preferably includes a sliding body.

The moving element is preferably movable within an outer sleeve, the moving element being movably mounted on a fluid conduit having an inner through bore and at least a pair of apertures in its side walls, the apertures being spaced apart axially along the conduit within the inflation valve arrangement. Preferably, a partition blocking fluid passage through the inner bore is disposed across the inner bore of the conduit between the apertures. Preferably, pressure is exerted on, is retained by and/or can build up against the partition when the inflation valve arrangement is shut. Preferably, the conduit is received in a channel formed in the moving element. Preferably, a chamber is formed within the moving element communicating with the channel and the conduit is disposed in the channel and crosses the chamber. Preferably, the chamber is configured to accommodate a length of the conduit comprising both apertures. Preferably, when the inflation valve arrangement is shut, at least one aperture (which may be an upper aperture) of the conduit is disposed within the channel such that passage of fluid at least through one aperture is prevented. Preferably, when the inflation valve arrangement is open, both apertures are located in the chamber such that fluid can flow out of the conduit through one aperture, such as an upper aperture, and re-enter the conduit at the other side of the partition through the other aperture, which may be a lower aperture. Preferably, fluid tight seals are provided between an outer surface of the conduit and an inner surface of the channel in the moving element so as to prevent fluid seeping from the conduit into the chamber when the inflation valve arrangement is shut.

The inflation valve arrangement further preferably comprises an inflation control arrangement. Preferably, the inflation control arrangement comprises a relief valve provided at the inlet of the inflatable element, the relief valve connecting the conduit with a space outside the inflation valve arrangement (e.g. an annular space or annulus between an exterior of the inflation valve arrangement and an inner surface of an external structure, e.g. a wellbore, casing, liner, open hole etc. in which well fluid inhabits). Preferably, the relief valve is normally shut and is configured to open for passage of fluid at a predetermined pressure, the predetermined pressure being indicative of the inflatable element having been fully inflated. In one arrangement, the predetermined pressure is less, preferably between 10% to 50% less and more preferably about 25% less, than a pressure required to cause the inflatable element to burst. When the relief valve opens, fluid starts to flow into the space outside of the inflation valve arrangement (which is preferably the annulus) and therefore inflation of the inflatable element stops. The flow of the fluid into the space (typically the annulus) external to the inflation valve arrangement causes a pressure drop to be observed in the inflation valve arrangement (and the string through which the fluid is delivered) providing an indication to an operator at the surface of the wellbore that the inflatable element has been fully inflated. The relief valve may comprise a rupture disc. Once the inflatable element has been fully inflated it supports itself firmly in the wellbore due to friction between the inflatable element and the inner wall of the wellbore and the so installed support device is capable of supporting the weight of plug forming compound delivered into the wellbore above the support device. Accordingly, the inflatable element can now be disconnected from the workstring (as will be described below) a barrier (plug) can be formed at this stage.

Preferably, the inflation control arrangement comprises a non-return valve at the inlet of the inflatable element preventing fluid from escaping from the inflatable element. The non-return valve may be a poppet valve. Preferably, the non-return valve is adapted to open at or above a predetermined hydraulic pressure differential between the hydraulic pressure inside the string (i.e. outside of the inflatable element) and the hydraulic pressure inside the inflatable element. This provides the advantage that fluid can enter the inflatable element, but is prevented from flowing out of the inflatable element, so that the fluid pressure increases inside the inflatable element thereby inflating and expanding the inflatable element towards the walls of the wellbore.

Preferably, the inflation control arrangement includes a safety valve arranged to act as a buffer between the conduit and the relief valve to prevent the relief valve from damage due to a sudden pressure surge during activation of the inflation valve. The safety valve is preferably a non-return valve which allows the fluid to flow through the safety valve towards the inflatable element but prevents the fluid from flowing in the opposite direction. The safety valve may be a poppet valve In one arrangement, the biasing means comprises a spring. Preferably, the biasing means biases the moving element within the outer sleeve into a position in which at least one aperture (which may be an upper aperture) of the conduit is disposed within the channel such that passage of fluid at least through one aperture (and, accordingly, throughout the inflation valve) is prevented.

In one arrangement, the actuation means is configured to releasably engage the wall of the inner bore of the external structure (e.g. workstring, casing, liner or inner surface of an open hole etc., and preferably a lower most outlet end of a string of tubulars) by one or more engaging elements, the or each engaging element protruding laterally from an outer surface of the inflation valve arrangement when the inflation valve arrangement is shut. The or each engaging elements are movably arranged on the inflation valve arrangement to move with respect to the inflation valve arrangement under the predetermined pressure so as to displace the locking mechanism and allow the moving element of the inflation valve arrangement to move into a position in which the inflation valve arrangement is open for passage of fluid. Preferably, the or each engaging elements are arranged to prevent the locking mechanism from shutting the inflation valve arrangement once the or each engaging elements have been displaced and moved the locking mechanism into the position in which the inflation valve arrangement is open for passage of fluid. Preferably, in the position in which the or each engaging elements block the locking mechanism the or each engaging elements are retracted or collapsed from their protruding positions with respect to the outer surface of the inflation valve arrangement so that the or each engaging elements are wholly or partially withdrawn into the interior of the inflation valve. Preferably, the or each engaging elements are configured to self lock in the retracted or collapsed position. The or each engaging elements may comprise one or more dogs movable in respective slots provided in the outer surface of the inflation valve arrangement and being retractable or collapsible into respective recesses in the outer surface of the inflation valve. Preferably, the external structure includes a correspondingly configured coupling portion. In one arrangement, the or each engaging elements and the coupling portion of the external structure include corresponding tapering portions which engage when the support device reaches the coupling portion and prevent the support device from slipping out through the outlet portion of the string into the wellbore.

In a preferred arrangement, the support device is delivered to a bottom outlet (or exit) portion of the string and the actuation means is adapted to engage automatically a wall of an inner bore of a coupling portion at the outlet portion of the string. In one arrangement, the coupling portion comprises a landing sub. In one arrangement the coupling portion comprises an open ended end coupling couplable to a distal end of the string.

Preferably, the coupling portion of the string is also adapted to be coupled with a bridge plug. With the support device and the method of the present invention, it is possible to deploy a bridge plug to a desired location down hole using the same string as for deploying the inflatable support tool all without having to separately trip out of the hole because one or more inflatable support tools can be deployed through the same string that was used to run in and set the bridge plug. This is particularly advantageous when it is necessary to isolate a section of a wellbore using a bridge plug rather than an inflatable support device (which may be the case in order to comply with certain regulations or for any other reason). In this case, the bridge plug attached to the distal end of the string, preferably via the end coupling, can be first delivered to a desired location, secured in place and then disconnected from the string. The wellbore can then be plugged above the bridge plug by delivering the fluid through the string, eliminating the need for a second run to deliver the fluid on top of the bridge plug. The bridge plug may be released from the string in a suitable manner, for example, by a combination of hydraulic and mechanical actions. For example, by dropping an object, such as a ball down the string, flow of fluid through the string can be obstructed thereby activating a first set of engaging members on the bridge plug and causing the first set of engaging members to engage a wall of an inner bore of an external structure (e.g. workstring, casing, liner or an inner surface of an open hole etc.). By overpulling the string, a second set of engaging members can be activated to engage the wall of the external structure. Once the bridge plug has been set in place, the bridge plug can be disconnected from the string by rotating the string. Once a sufficient amount of fluid such as cement has been delivered on top of the bridge plug and once the tool string has been moved up the wellbore to the desired location, a support tool in accordance with the present invention can be deployed from surface through the same string and inflated without the need for a separate run. Since the same coupling portion is used to deliver the bridge plug and to deploy the support device, one bridge plug and multiple support devices can be delivered on the same string allowing the wellbore to be plugged at several zones without requiring multiple trips of the workstring.

The support device of the present invention provides a superior inflation valve arrangement which ensures that inflation is initiated only when the support device reaches a particular position in the wellbore (e.g. a bottom end of the string) and not while the support device is being manoeuvred through the string. Furthermore, the inflation control arrangement of the valve firstly prevents the inflatable element from bursting and at the same time serves as a signal means to an operator at the surface of the wellbore that the inflatable element has been inflated and that it can be disconnected from the workstring so that the borehole above the support device can be plugged with a plugging compound, such as cement.

The disconnect mechanism preferably comprises a latch mechanism which prevents the inflation valve arrangement from disconnecting from the string when the inflatable element is being inflated. The latch mechanism is arranged to disengage from the string when the inflatable element has been inflated and securely positioned across the wellbore by pulling the string from surface. Alternatively, the latch mechanism can be disengaged from the string by applying more pressure to the inflation valve. The latter method is preferably employed as a contingency release method in case the support device fails for any reason, such as failure of the inflatable element or of the relief valve. In case of failure of the relief valve, a through aperture of the relief valve is small compared to the internal diameter of the fluid passageway of the inflation valve arrangement such that if the relief valve opens too early increase in fluid pressure in the string will result in sufficient pressure acting on the disconnect mechanism to release the support device from the string. The latch mechanism may comprise one or more engaging elements which protrude laterally from the outer surface of the inflation valve arrangement in a latching position to engage the wall of the inner bore of the external structure (e.g. workstring, casing, liner or an inner surface of an open hole etc.) and are withdrawn inwardly towards a central axis of the inflation valve arrangement in a release mode, such that the inflation valve arrangement is released from the workstring. Preferably, the or each engaging elements of the latch mechanism are biased into the latching position by a bias means of the latching mechanism. Preferably, the bias force of the bias means is overcome by pulling the string from surface with a certain force or by applying a certain pressure to the inflation valve arrangement from surface. Preferably, the or each engaging elements are provided on a mandrel and an end portion of the inflation valve arrangement is received in the mandrel, the mandrel and the end portion of the inflation valve arrangement received therein being biased into engagement by the bias means. In one arrangement, the mandrel and the end portion of the inflation valve arrangement include cooperating tapering surfaces further locking the mandrel and the inflation valve arrangement together and holding the or each engaging elements in the protruding positions. Upon overcoming the force of the bias means the mandrel disengages and moves axially away from the end portion of the inflation valve arrangement whereby the or each engaging elements are allowed to move radially inwardly to allow the mandrel and, as a result, the entire support device, to disengage from the string as the inflation valve arrangement no longer holds the or each engaging elements in the protruding position. Preferably, the latch mechanism is adapted to allow fluid to flow between said string and the inflation valve arrangement.

It will be appreciated that the above described latch mechanism is not limited to the use with the support device of the present invention and indeed can find use in disconnecting other devices (e.g. perforation guns) from a workstring down hole. Thus, in another aspect, the invention provides a latching mechanism as described above for use in disconnecting another device from a string in a wellbore.

In a preferred arrangement, the support device comprises a burst preventing outer sheath covering the inflatable element. In a preferred arrangement, the sheath is made from a pliable material is also capable of withstanding high impact and is also preferably relatively strong particularly in tension and may be relatively lightweight and may preferably be a fabric. In one arrangement, the outer sheath is made from Kevlar®, preferably a woven Kevlar®. It will be appreciated that the invention is not limited to the use of Kevlar® and indeed other suitable materials will be apparent to a person skilled in the art. In a preferred arrangement, the outer sheath is shaped so as to accommodate a fully inflated inflatable element. Preferably, the size and shape of the outer sheath when accommodating the inflatable element, which has been inflated to a predetermined fully inflated state, matches the size and shape of the so inflated inflatable element. At the same time the outer sheath is preferably sized and shaped so that its outer diameter substantially matches an inner diameter of the wellbore for which the support device is designed and, more preferably, the outer sheath comprises a substantially cylindrical tube having a relatively constant diameter along its length. Preferably, the outer sheath is configured so as to prevent further inflation of the inflatable element beyond is predetermined fully inflated state. Preferably, the outer sheath is wrapped or folded around the inflatable element in the deflated state of the inflatable element so that the outer sheath gradually expands as the inflatable element is being inflated until the outer sheath assumes its fully expanded (or unfolded) configuration. Preferably, in the fully expanded configuration of the outer sheath further inflation of the inflatable element is not possible, but at the same time sufficient pressure is allowed to build up to activate the relief valve. The outer sheath material may or may not be elastomeric. The outer sheath material may be woven or non-woven. The burst preventing outer sheath provides a reliable and inexpensive safety feature preventing the inflatable element from overinflation and/or accidental burst.

The workstring may be any one of a string of tubulars such as a drill pipe string, a coiled tubing string or may be a slickline (if a suitable downhole actuation tool is also run). More preferably, the workstring comprises one of a string of tubulars such as a drill pipe string or a coiled tubing string. Alternatively, the string of tubulars may be a liner or casing string.

The present invention provides the advantage that a wellbore barrier can be placed and sufficiently secured anywhere within the wellbore, either permanently or temporarily, using a dedicated displacement fluid utilized within the wellbore. For example, the displacement fluid may be cement slurry or an elastomeric compound, such as a resin. It will however be appreciated that any other suitable flowing substance (e.g. such as fluid, fluidized solids, granular and powdery matters) can be used.

The support device of the present invention eliminates the need for a specific run to deploy the support device downhole as both the deployment of the support device and plugging the wellbore are completed using the same string of tubulars without the need to withdraw the string prior to cementing. Moreover, the support device and the fluid used to plug the wellbore are delivered downhole simultaneously. The support device of the present invention provides a very reliable mechanism for creating a barrier that is adapted to not only support, for example, a cement slurry placed on top of the support device, but also to sufficiently seal off the wellbore in order to prevent contamination of the wellbore section below the support device during operation. The support device of the present invention provides for safe and reliable inflation, reduces the risk of failure and safe and timely disconnection of the support device from the string.

In addition, the support device of the present invention provides the advantage that the strength of the support device can be tested during installation, thus, minimizing the risk of potential damage during inflation and/or structural failure of the support device when placing the fluid on top of the support device.

Also, delivering and securing the support device and delivering the fluid down hole, such as cement material, used within the wellbore is carried out simultaneously, minimizing time and costs needed for deployment and subsequent constructive work inside the wellbore. Furthermore, since the same string is used to deliver the support device and the fluid, multiple support devices can be delivered on the same string allowing the wellbore to be plugged at several zones. Furthermore, because the inflatable element of the support device can be delivered to the predetermined location inside the wellbore in its deflated state, no further packaging or diameter reducing arrangement of the support device is necessary. Furthermore, a plurality of successively launched support devices with respective columns of fluid used for plugging can be pumped through the string from surface as the string is pulled out of the well such that an inflatable support tool is inflated and disconnected from the string at a desired location such as just above each respective zone in the wellbore thereby permitting a wellbore to be abandoned in one trip out of the wellbore.

The inflatable element is preferably expandable on inflation, preferably, widthwise and, preferably, lengthwise. This provides the advantage that the deflated profile can be relatively small compared to the volume occupied in its inflated and expanded state.

The inflatable element may define a receptacle adapted to expand from a deflated state into a predetermined shape having at least one contact portion adapted to engage with the wall of the wellbore, if applicable, via a burst protection outer sheath. The said contact portion may be substantially cylindrical with respect to a longitudinal axis of the wellbore. This provides the advantage that contact interface between an inner surface of the wellbore wall or an inner surface of the wellbore casing/liner string and an outer surface of the support device is maximised, resulting in maximised friction and support strength between the wall and the support device. In addition, the inflatable element is capable of conforming to the profile of the wellbore wall thereby providing an optimized sealing engagement between the wellbore wall and the support device and minimizing the risk of contamination of the space below the support device.

Advantageously, the inflatable element may be made from a polymeric material, which may be an elastomeric material. Polymeric material such as natural or synthetic rubber, silicon, PVC or any other suitable polymeric compound may be used, because the elastic properties allow recoverable deformation that is strong enough to withstand the stresses occurring during deployment and is readily available.

The specifically designed actuation mechanism allows the support device to be automatically secured at the outlet portion of the string of tubulars such that the inflatable element is operatively located at the predetermined location of the wellbore, further allowing a seamless positioning, inflation, and deployment of the support device without any unnecessary steps having to be undertaken by the operator.

The latch mechanism prevents the support device from uncontrolled disconnection after the inflatable element has been inflated and allows an operator to time the disconnection of the support device from the string according to the particular circumstances of the deployment operation.

The inflatable element may comprise an additive adapted to accelerate the hardening process of the fluid received in said inflatable element. This provides the advantage that the support device provides a secure and reliable support before further fluid is deposited on top of the support device, thereby minimizing the risk of the additional load compromising the structural integrity of the support device.

The support device of the invention provides sufficient support during the formation of a wellbore structure such as a wellbore compound plug or during a casing cementing operation, wherein the support device can either be integrated permanently with the plug, or temporarily installed for the duration of a casing cementing operation in a section of the wellbore. Furthermore, during the formation of the wellbore structure, the fluid is prevented from slumping into the space below the support device, therefore minimizing possible contamination.

According to a second aspect of the present invention, there is provided a method for deploying a barrier in a wellbore, comprising the steps of:

(a) providing and securing a downhole support device in accordance with the first aspect of the invention at a bottom outlet of a string of tubulars, such that the inflatable element of the support device is positioned outside said string of tubulars at a predetermined location inside the wellbore, and (b) inflating said inflatable element with a flowing substance through a first outlet port of said string of tubulars, into a sealing engagement with the wellbore walls.

In the operation of providing a compound plug in a wellbore, the method preferably comprises the steps of:

(c) detaching the support device from said string of tubulars, (d) delivering an amount of flowing substance (which is preferably a predetermined amount of flowing substance) through said first outlet port on top of said secured downhole support device, and (e) allowing the flowing substance to harden, thereby defining a compound plug in the wellbore.

Advantageously, step (c) may be initiated by providing a predetermined hydraulic pressure at said first outlet port or by pulling the string upwardly from surface.

Step (b) may further include providing an additive adapted to accelerate the hardening process of the flowing substance received in said inflatable element.

Alternatively, in the operation of plugging a string of tubulars such as a casing or liner string, the method including steps (a) and (b) may further comprise the alternative steps of:

(d) initiating closing of said first outlet port and opening at least one second outlet port to permit said flowing substance in said string of tubulars to flow into a space of the wellbore, such as an annulus, above said downhole support device;

(e) delivering an amount (which is preferably a predetermined amount) of flowing substance through said at least one second outlet port on top of said secured downhole support device.

These alternative steps (d), (e) provide the advantage that a casing can be secured into place inside the wellbore using the support device to redirect the fluid, e.g. non-hardened cement slurry, into a space or annulus defined by an outer surface of the string of tubulars to be secured and the inner surface of the wellbore walls.

Preferably, the method includes the step of actuating the inflation valve arrangement at a predetermined fluid pressure acting on the inflation valve arrangement to enable inflation of the inflatable element.

Preferably, the method includes providing a locking mechanism and, by means of the locking mechanism, keeping the inflation valve arrangement shut until the predetermined pressure has been reached. Preferably, the method comprises overcoming a force of the locking mechanism keeping the inflation valve arrangement shut by applying the predetermined fluid pressure for actuating the inflation valve arrangement to enable inflation of the inflatable element wherein the predetermined fluid pressure for actuating the inflation valve arrangement is greater than the force of the locking mechanism keeping the inflation valve arrangement shut.

Preferably, the method includes biasing a moving element of the inflation valve arrangement into a first position blocking a fluid passageway through the inflation valve arrangement into the inflatable element. The method preferably further comprises overcoming the bias by increasing the pressure of the fluid acting on the inflation valve arrangement and causing the moving element to moved into a second position in which the fluid passageway through the inflation valve arrangement into the inflatable element is open. The method preferably includes biasing the inflation valve arrangement into a shut position while delivering the support device through the string.

Preferably, the method includes keeping an actuation means of the inflation valve arrangement in a releasable engagement with a wall of an inner bore of an external structure (e.g. workstring, casing, liner or an inner surface of an open hole etc.) while biasing the actuation means into the shut position thereby keeping the inflatable element connected with the external structure before the inflatable element is inflated and can support itself in the wellbore. Preferably, the method comprises causing the external structure to activate the actuation means by applying the predetermined pressure to the support device so that a reaction force acting from the external structure on the actuation means causes relative displacement of the moving element into the second position in which the fluid passageway through the inflation valve arrangement into the inflatable element is open.

In one arrangement, the method includes providing the inflation valve arrangement in the form of a sliding valve.

Preferably, the method includes the step of movably mounting the moving element on a fluid conduit having a through inner bore and at least a pair of apertures in its side walls, the apertures being spaced apart axially along the conduit within the inflation valve. Preferably, the method includes disposing a partition blocking fluid passage through the inner bore across the inner bore of the conduit between the apertures. Preferably, the method includes exerting pressure against the partition when the inflation valve arrangement is shut. Preferably, the method includes inserting the conduit in a channel formed in the moving element communicating with a chamber formed within the moving element such that the conduit is disposed in the channel and crosses the chamber, wherein, preferably, the chamber is configured to accommodate a length of the conduit comprising both apertures. Preferably, the method includes, when the inflation valve arrangement is shut, disposing at least one aperture (which may be an upper aperture) of the conduit within the channel and preventing passage of fluid at least through one aperture. Preferably, the method includes, when the inflation valve arrangement is open, locating both apertures in the chamber and allowing fluid to flow out of the conduit through one aperture, such as an upper aperture, and re-enter the conduit at the other side of the partition through the other aperture, which may be a lower aperture. Preferably, the method includes providing fluid tight seals between an outer surface of the conduit and an inner surface of the channel in the moving element so as to prevent fluid seeping from the conduit into the chamber when the inflation valve arrangement is shut. Preferably, the method comprises providing the moving element of the inflation valve arrangement in the form of a sliding body.

The method preferably includes controlling the inflation of the inflatable element by means of an inflation control arrangement of the inflation valve arrangement. Preferably, the method includes using a relief valve provided at the inlet of the inflatable element, the relief valve connecting the conduit with a space outside the inflation valve arrangement (e.g. an annular space or annulus between an exterior of the inflation valve arrangement and an inner surface of an external structure, e.g. a wellbore, casing, liner, open hole etc. in which well fluid inhabits). Preferably, the method includes keeping the relief valve normally shut and causing the relief valve to open for passage of fluid at a predetermined pressure, the predetermined pressure being indicative of the inflatable element having been fully inflated. In one arrangement, the predetermined pressure is less, preferably, about 25% less, than a pressure required to cause the inflatable element to burst. The method further includes allowing fluid to flow into the space outside of the inflation valve arrangement (which is preferably the annulus) when the relief valve opens, and therefore causing the inflation of the inflatable element to stop. The method includes observing a pressure drop in the inflation valve arrangement (and the string through which the fluid is delivered) caused by the flow of the fluid into the space (typically the annulus) external to the inflation valve arrangement as an indication that the inflatable element has been fully inflated. The relief valve may comprise a rupture disc.

The method includes the step of disconnecting the inflatable element from the workstring (as will be described below) once the inflatable element has been fully inflated. The method advantageously includes pumping fluid through the same string above the support device to form a barrier above the support device without pulling out the string after the installation of the support device and before delivering the barrier forming fluid. Further advantageously, the method includes forming the barrier by delivering the barrier forming fluid into the wellbore above the support device while withdrawing the string.

Ideally, the method comprises delivering the support device to the distal outlet end of the string by pumping fluid through the string and thus causing the support device to advance along the string. Preferably, the fluid used for delivering the support device is the same fluid used for forming a barrier.

Preferably, the method comprises providing a non-return valve at the inlet of the inflatable element for preventing fluid from escaping from the inflatable element. The non-return valve may be a poppet valve. Preferably, method comprises opening the non-return valve at or above a predetermined hydraulic pressure differential between the hydraulic pressure inside the string (i.e. outside of the inflatable element) and the hydraulic pressure inside the inflatable element allowing fluid to enter the inflatable element, but preventing the fluid from flowing out of the inflatable element, so that the fluid pressure increases inside the inflatable element thereby inflating and expanding the inflatable element towards the walls of the wellbore.

Preferably, the method includes providing a safety valve, such as a non-return valve, e.g. a poppet valve, arranged to act as a buffer between the conduit and the relief valve to prevent the relief valve from damage due to a sudden pressure surge during activation of the inflation valve.

Preferably, the method includes biasing the moving element within the outer sleeve into a position in which at least one aperture (which may be an upper aperture) of the conduit is disposed within the channel such that passage of fluid at least through one aperture (and, accordingly, throughout the inflation valve) is prevented.

In one arrangement, the method includes arranging the actuation means to releasably engage the wall of the inner bore of the external structure (e.g. workstring, casing, liner or inner surface of an open hole etc., and preferably a lower most outlet end of a string of tubulars) by one or more engaging elements, the or each engaging element protruding laterally from an outer surface of the inflation valve arrangement when the inflation valve arrangement is shut. Preferably, the method includes movably arranging the or each engaging elements on the inflation valve arrangement and moving the or each engaging elements with respect to the inflation valve arrangement under the predetermined pressure so as to displace the locking mechanism and allow the moving element of the inflation valve arrangement to move into a position in which the inflation valve arrangement is open for passage of fluid. Preferably, the method includes arranging the or each engaging elements on the inflation valve arrangement so as to prevent the locking mechanism from shutting the inflation valve arrangement once the or each engaging elements have been displaced and moved the locking mechanism into the position in which the inflation valve arrangement is open for passage of fluid. Preferably, the method includes arranging the or each engaging elements such that in the position in which the or each engaging elements block the locking mechanism the or each engaging elements are retracted or collapsed from their protruding positions with respect to the outer surface of the inflation valve arrangement so that the or each engaging elements are wholly or partially withdrawn into the interior of the inflation valve. Preferably, the method includes causing the or each engaging elements to self lock in the retracted or collapsed position. The or each engaging elements may comprise one or more dogs movable in respective slots provided in the outer surface of the inflation valve arrangement and being retractable or collapsible into respective recesses in the outer surface of the inflation valve. Preferably, method includes providing the external structure with a correspondingly configured coupling portion. In one arrangement, the method includes proving the or each engaging elements and the coupling portion of the external structure with corresponding tapering portions which engage when the support device reaches the coupling portion and prevent the support device from slipping out through the outlet portion of the string into the wellbore.

Preferably, the method includes the step of delivering the support device to a bottom outlet (or exit) portion of the string whereby the actuation means engages automatically a wall of an inner bore of a coupling portion at the outlet portion of the string. In one arrangement, the coupling portion comprises a landing sub. In one arrangement the coupling portion comprises an open ended end coupling couplable to a distal end of the string.

Preferably, the method comprises coupling the coupling portion of the string with a bridge plug. Preferably, the method includes deploying a bridge plug to a desired location down hole using the same string as for deploying the inflatable support tool to isolate a section of a wellbore. In this case, the method preferably includes attaching the bridge plug to the distal end of the string, delivering the bridge plug to a desired location, securing the bridge plug in place and then disconnecting the bridge plug from the string. The method preferably further includes forming a barrier in the wellbore above the bridge plug by delivering the fluid through the string, thereby eliminating the need for a second run to deliver the fluid on top of the bridge plug. Preferably, the method includes the step of releasing the bridge plug from the string in a suitable manner, for example, by a combination of hydraulic and mechanical actions. For example, by dropping an object, such as a ball down the string, flow of fluid through the string can be obstructed thereby activating a first set of engaging members on the bridge plug and causing the first set of engaging members to engage a wall of an inner bore of an external structure (e.g. workstring, casing, liner or an inner surface of an open hole etc.). By overpulling the string, a second set of engaging members can be activated to engage the wall of the external structure. Once the bridge plug has been set in place, the method preferably includes the step of disconnecting the bridge plug from the string, for example, by rotating the string. Once a sufficient amount of fluid has been delivered on top of the bridge plug, the method preferably includes the step of deploying a support tool of the present invention from surface through the same string and inflating the inflatable element of the support tool, without pulling out the string prior to delivering the support tool. Advantageously, the method comprises delivering multiple bridge plugs and multiple support devices on the same string and forming barriers in the wellbore at several zones using the same coupling portion to deliver bridge plugs and to deploy support devices.

The method preferably includes providing the disconnect mechanism with a latch mechanism and by means of the latch mechanism preventing the inflation valve arrangement from disconnecting from the string when the inflatable element is being inflated. The method preferably includes the step of disengaging the latch mechanism from the string when the inflatable element has been inflated and securely positioned across the wellbore by pulling the string from surface. Alternatively, the latch mechanism can be disengaged from the string by applying more pressure to the inflation valve. The latter method is preferably employed as a contingency release method in case the support device fails for any reason, such as failure of the inflatable element or of the relief valve. In case of failure of the relief valve, a through aperture of the relief valve is small compared to the internal diameter of the fluid passageway of the inflation valve arrangement such that if the relief valve opens too early increase in fluid pressure in the string will result in sufficient pressure acting on the disconnect mechanism to release the support device from the string. The method may include providing the latch mechanism with one or more engaging elements which protrude laterally from the outer surface of the inflation valve arrangement in a latching position to engage the wall of the inner bore of the external structure (e.g. workstring, casing, liner or an inner surface of an open hole etc.) and withdrawing the or each engaging elements inwardly towards a central axis of the inflation valve arrangement in a release mode, such that the inflation valve arrangement is released from the workstring. Preferably, the method includes biasing the or each engaging elements of the latch mechanism into the latching position by a bias means of the latching mechanism. Preferably, the method includes the step of overcoming the bias force of the bias means by pulling the string from surface with a certain force or by applying a certain pressure to the inflation valve arrangement from surface. Preferably, the method includes providing the or each engaging elements on a mandrel such that an end portion of the inflation valve arrangement is received in the mandrel whereby the mandrel and the end portion of the inflation valve arrangement received therein are biased into engagement by the bias means. In one arrangement, the mandrel and the end portion of the inflation valve arrangement include cooperating tapering surfaces further locking the mandrel and the inflation valve arrangement together and holding the or each engaging elements in the protruding positions. Upon overcoming of the force of the bias means the mandrel, the method preferably includes disengaging the mandrel from the end portion of the inflation valve arrangement and moving the mandrel axially away from the end portion of the inflation valve arrangement whereby the or each engaging elements are allowed to move radially inwardly to allow the mandrel and, as a result, the entire support device, to disengage from the string as the inflation valve arrangement no longer holds the or each engaging elements in the protruding position. Preferably, the method includes allowing fluid to flow between said string and the inflation valve arrangement through the latch mechanism.

It will be appreciated that the above described method of using a latch mechanism is not limited to the use with the support device of the present invention and indeed can find use in disconnecting other devices (e.g. perforation guns) from a workstring down hole. Thus, in another aspect, the invention provides using a latching mechanism as described above in disconnecting another device from a string in a wellbore.

In a preferred arrangement, the method comprises the step of providing the inflation valve arrangement with a burst preventing outer sheath covering the inflatable element. In a preferred arrangement, the sheath is made from a pliable material and is also preferably capable of withstanding high impact and may also be relatively strong particularly in tension and may be a relatively lightweight fabric. In one arrangement, the outer sheath is made from Kevlar®, preferably a woven Kevlar®. It will be appreciated that the invention is not limited to the use of Kevlar® and indeed other suitable materials will be apparent to a person skilled in the art. In a preferred arrangement, the method includes forming the outer sheath such that the outer sheath accommodates a fully inflated inflatable element. Preferably, the method includes the step of sizing and shaping the outer sheath such that when accommodating the inflatable element, which has been inflated to a predetermined fully inflated state, the outer sheath matches the size and shape of the so inflated inflatable element. At the same time, method preferably includes the step of sizing and shaping the outer sheath so that its outer diameter substantially matches an inner diameter of the wellbore for which the support device is designed. The outer sheath may comprise a substantially cylindrical tube having a relatively constant diameter along its length. Preferably, the method includes configuring the outer sheath so as to prevent further inflation of the inflatable element beyond is predetermined fully inflated state. Preferably, the method includes wrapping or folding the outer sheath around the inflatable element in the deflated state of the inflatable element and causing the outer sheath to expand gradually as the inflatable element is being inflated until the outer sheath assumes its fully expanded (or unfolded) configuration. Preferably, the method includes preventing further inflation of the inflatable element in the fully expanded configuration of the outer sheath, but at the same time allowing sufficient pressure to build up to activate the relief valve. The outer sheath material may or may not be elastomeric. The outer sheath material may be woven or non-woven.

All essential and optional features of the first aspect of the invention can be provided in conjunction with any of the essential or optional features of the second aspect of the invention and vice versa as appropriate.

BRIEF DESCRIPTION OF THE DRAWINGS

Embodiments of the present invention will now be described, by way of example only and not in any limitative sense, with reference to the accompanying drawings, in which.

DETAILED DESCRIPTION OF THE INVENTION

Figure 1:
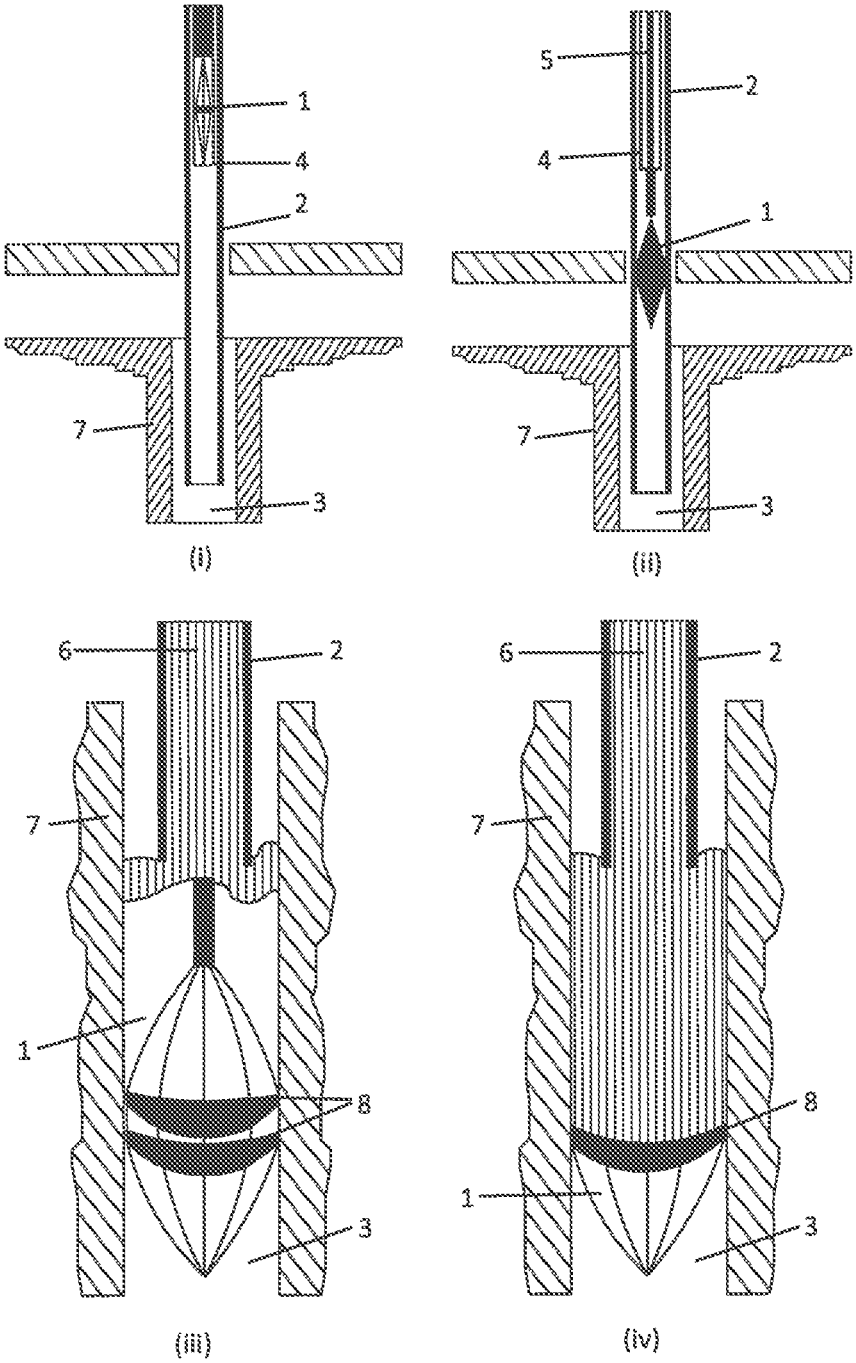
FIGURE 1 (PRIOR ART)
FIG. 1 shows a schematic sectional side view of a conventional cement support tool (Perigon™ CST): (i) inside a transport tube before it is placed into the string of tubulars, (ii) during delivery through the string of tubulars inside the wellbore, (iii) deployed at a location inside the wellbore and (iv) supporting cement slurry placed on top of the cement support tool.
Figure 2:
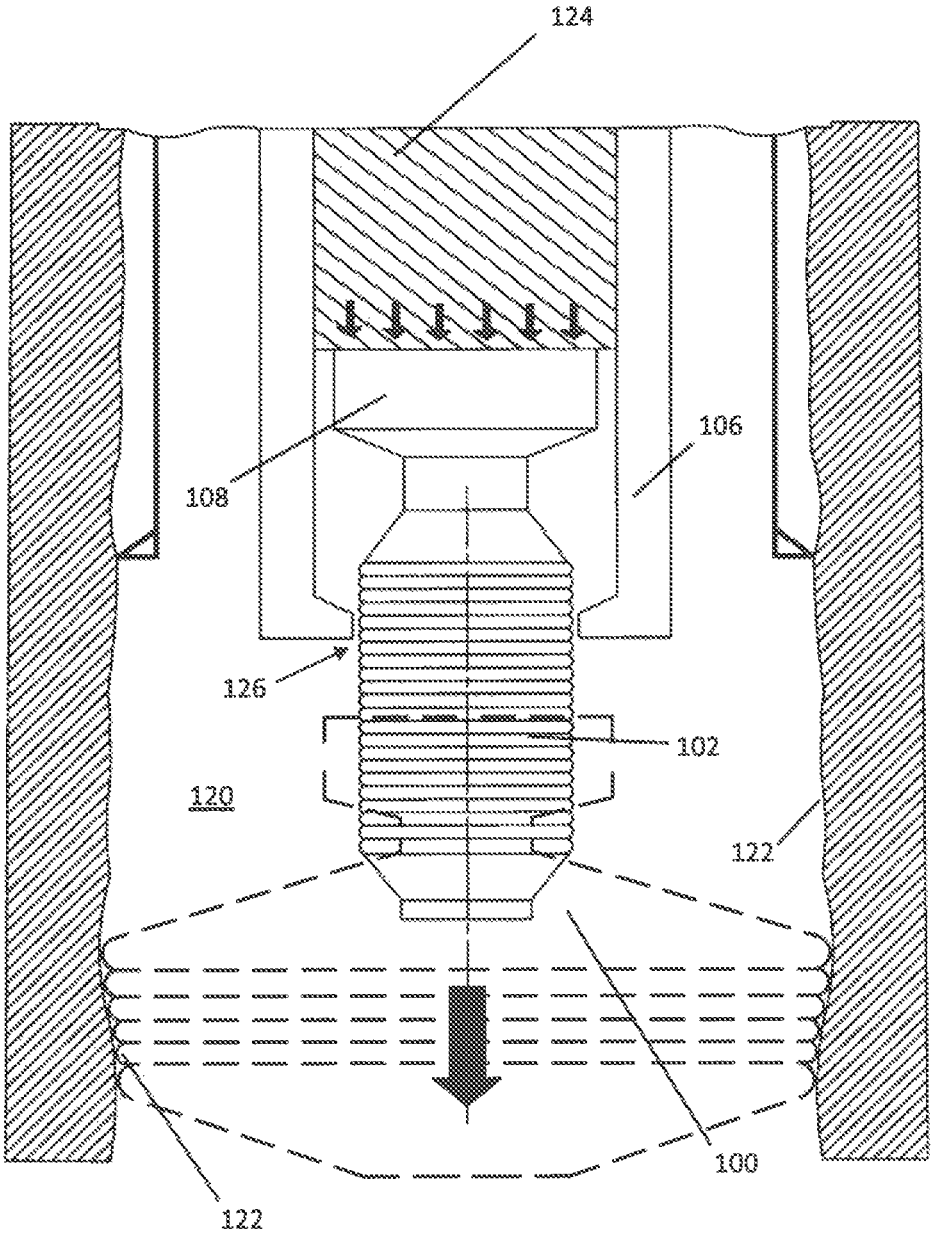
FIGURE 2 (PRIOR ART)
FIG. 2 shows a simplified schematic side view of a prior art support device in situ during detachment of an inflatable element from a string of tubulars.

Referring to FIGS. 3 to 14 a support device for use in a wellbore 202 (including casing, liner, open hole etc.) and adapted to be run into the wellbore 202 through or on a workstring 204 (which may be hereinafter referred to as "string" for brevity) of tubulars in accordance with the present invention is indicated generally by reference numeral 200. Preferably, the support device 200 is delivered to a bottom outlet portion 205 of the string 204 by the fluid and the same fluid is used to plug the wellbore 202 above the support device 200 after the support device 200 has been installed in the wellbore 202.

The support device 200 comprises an expandable inflatable element 206 having an inlet port 208 for receiving and being inflated by a flowing substance (not shown) herein after referred to as "fluid" for brevity. Generally, the flowing substance can comprise fluid, fluidized solids, granular and powdery matters. Typically, however, a suitable fluid such as drilling mud, water or cement slurry or an elastomeric compound, such as a resin, are used for forming plugs in a wellbore. The inflatable element 206 is coupled to an inflation mechanism 210 (described below).

The inflatable element 206 may be made from a polymeric material, which may be an elastomeric material. Polymeric material such as natural or synthetic rubber, silicon, PVC or any other suitable polymeric compound may be used, because the elastic properties allow recoverable deformation that is strong enough to withstand the stresses occurring during deployment and is readily available. The inflatable element 206 is expandable on inflation widthwise and lengthwise. This provides the advantage that the deflated profile of the inflatable element 206 is relatively small compared to the volume occupied in its inflated and expanded state. The inflatable element 206 expands on inflation from a deflated state into a predetermined shape having at least one contact portion 212 adapted to engage with a wall 214 of the wellbore 202 (via a burst protection outer sheath 216 as will be described below). The inflatable element 206 applies a biasing force to the wellbore wall 214 in an inflated state. In the presently described embodiment, the contact portion 212 is substantially cylindrical with respect to a longitudinal axis of the wellbore 202. This provides the advantage that a contact interface between an inner surface 214*a* (which may be an inner surface of the wellbore casing/liner string or an inner surface of an open hole) of the wellbore wall 214 and an outer surface 216*a* of the inflatable element 206 is maximised, resulting in maximised friction and support strength between the wall 214 and the support device 200. In addition, the inflatable element 206 conforms to the profile of the wellbore wall 214 in the inflated state thereby providing an optimized sealing engagement between the wellbore wall 214 and the support device 200 and minimizing the risk of contamination of the space below the support device 200.

Figure 3:
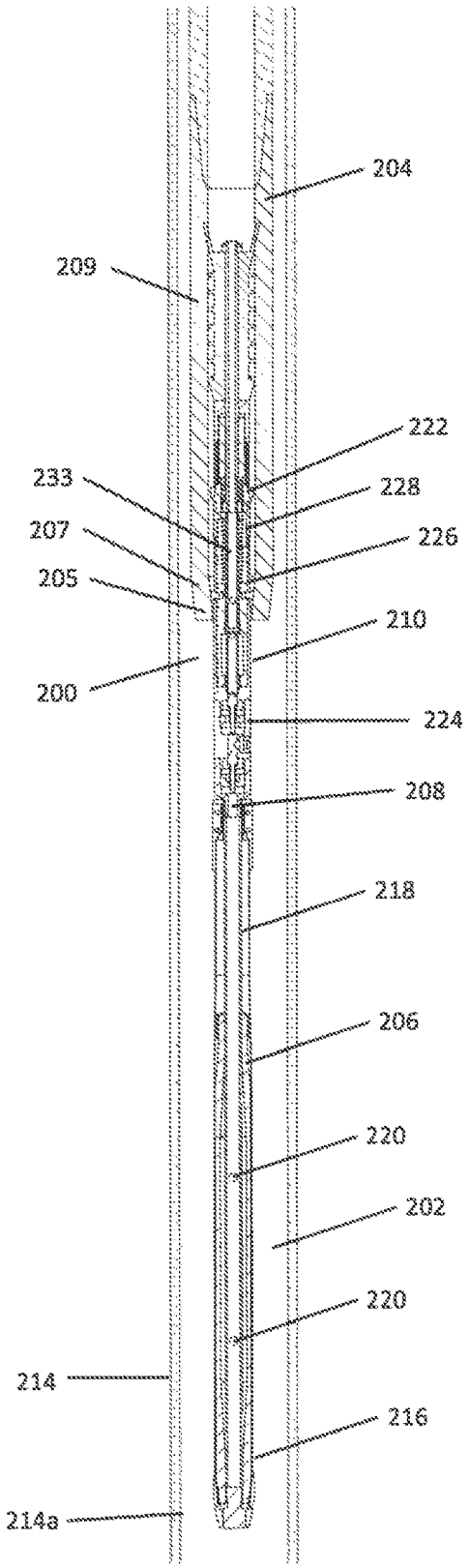
FIG. 3 shows a schematic cross-sectional elevation of the support device of the present invention delivered in a deflated state to a distal end of a string of tubulars.
Figure 7:
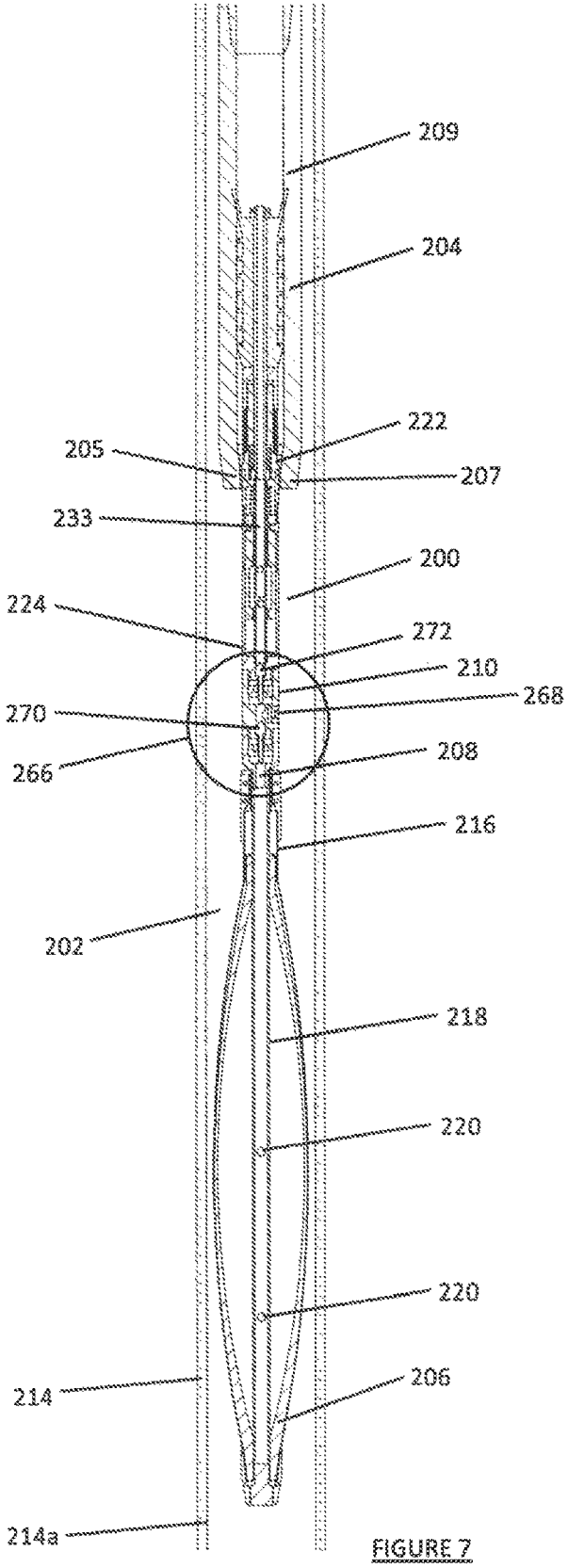
FIG. 7 is a schematic cross-sectional elevation of the support device of the present invention in a partially inflated state.
Figure 7B:
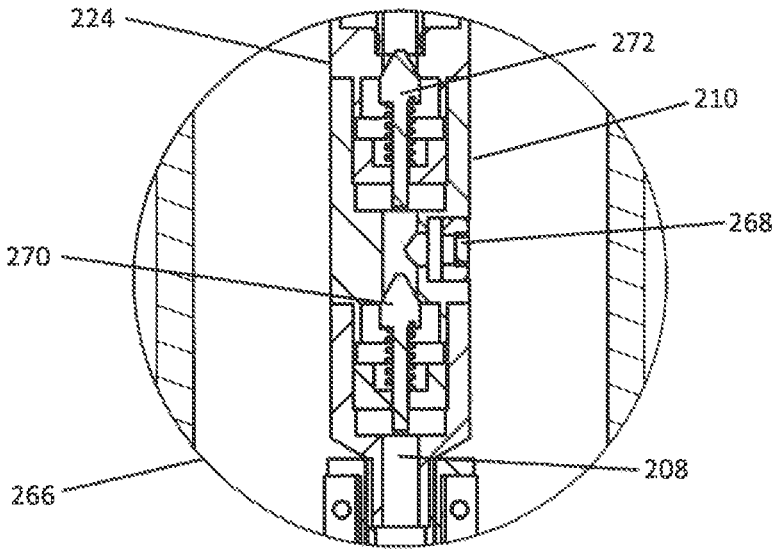
FIG. 7*b* is a close up and more detailed view of inflation control arrangement 266 generally circled in FIG. 7.
Figure 8:
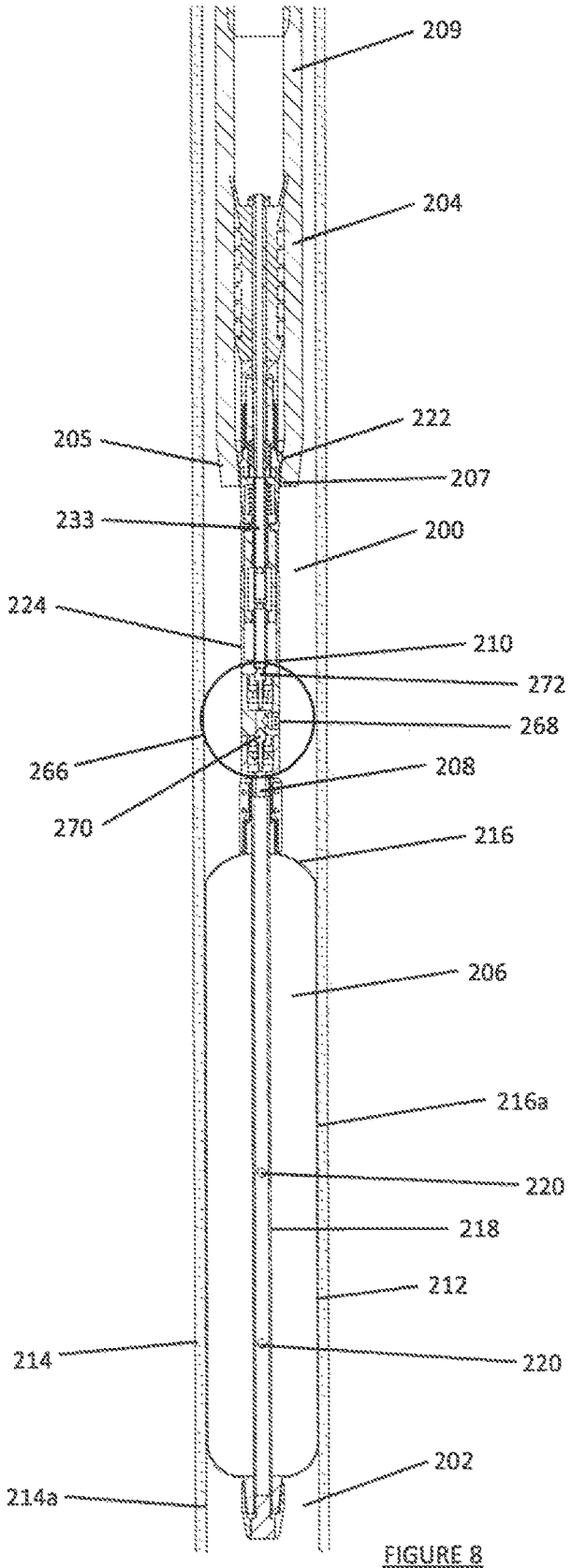
FIG. 8 is a schematic cross-sectional elevation of the support device of the present invention in a fully inflated state.
Figure 11:
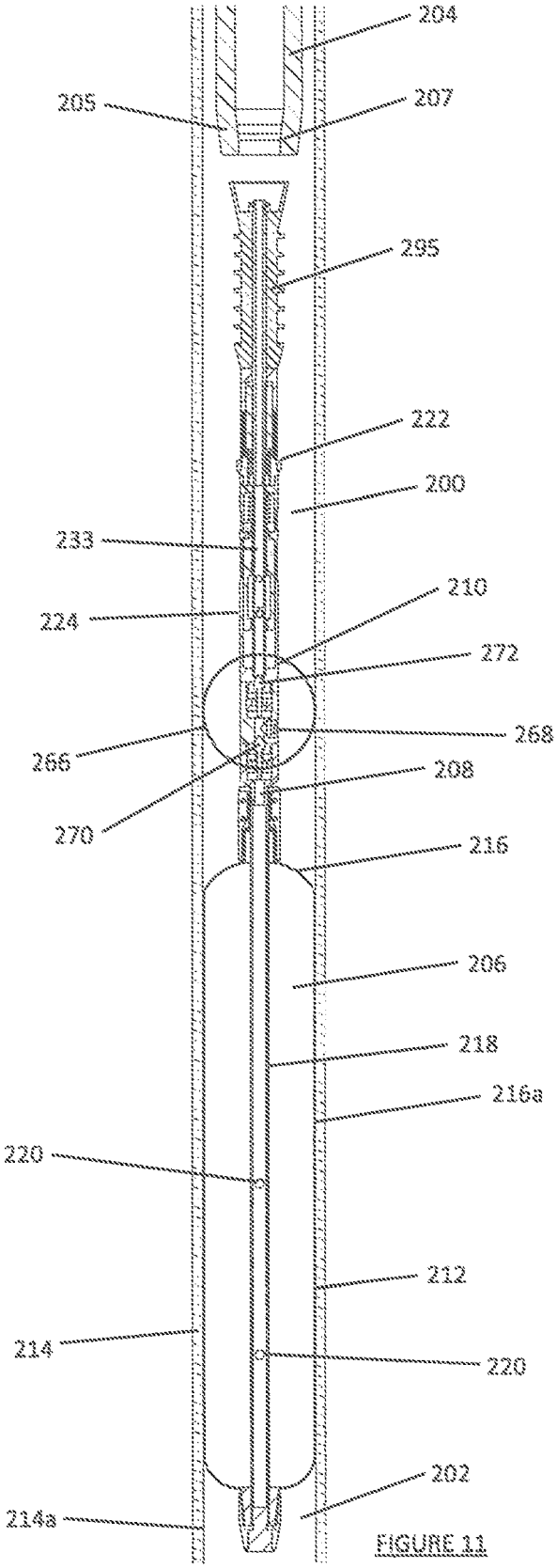
FIG. 11 is a schematic cross-sectional elevation of the support device of the present invention in a fully inflated state and separated from the string.

An inflation tube 218 having apertures 220 is received in the inflatable element 206 for inflating the inflatable element 206 via the apertures 220. As shown in FIG. 3, in a deflated state of the inflatable element 206 a certain length of the inflation tube 218 protrudes outside of the inflatable element 206. As the inflatable element 206 expands lengthwise while being inflated, the whole of the inflation tube 218 becomes housed within the inflatable element 206, as shown in FIGS. 7, 8 and 11. As will be described below, the inflatable element 206 is adapted to be selectively connected to the workstring 204 and to selectively disconnect from the workstring 204 via a disconnect mechanism 222.

The inflation mechanism 210 comprises an inflation valve 224 (illustrated in more detail in FIGS. 4 to 6) at the inlet 208 of the inflatable element 206. In the presently described embodiment, the inflation valve 210 is a sliding valve. The inflation valve 224 comprises an outer sleeve 230 and a moving element 232 (in the present embodiment provided in the form of a sliding body) movably disposed inside the outer sleeve 230 to open or close the inflation valve 224.

The inflation valve 224 comprises an actuation means 226 (as will be described below in more detail) adapted to actuate the inflation valve 224 at a predetermined pressure acting on the inflation valve 224 in order to inflate the inflatable element 206. The inflation valve 224 further comprises a locking mechanism 228 (as will be described below in more detail) keeping the inflation valve 224 shut (i.e. preventing fluid from passing throughout the inflation valve 224) until the predetermined pressure has been reached. The predetermined fluid pressure for actuating the inflation valve 224 to enable inflation of the inflatable element 224 is greater than a force of the locking mechanism 228 required to keep the inflation valve 224 shut.

The locking mechanism 228 comprises a biasing means 234 (provided in the form of a spring in the presently described embodiment) disposed between respective end faces 236, 238 of the outer sleeve 230 and the moving element 232 and arranged to bias the outer sleeve 230 and the moving element 232 away from each other thereby biasing the moving element 232 into a first position (as in FIGS. 3 to 5) blocking a fluid passageway 233 through the inflation valve 224 into the inflatable element 206. The biasing means 234 is configured so that its force can be overcome (as will become more apparent from the description below) by increasing the pressure of the fluid in the workstring 204 acting on the inflation valve 224 so that the moving element 232 is moved into a second position (as in FIG. 6) in which the fluid passageway 233 through the inflation valve 224 into the inflatable element 206 is open. The biasing means 234 also biases the moving element 232 into the shut position during delivery of the support device 200 through the string 204 to the required location in the wellbore 202.

Figure 4:
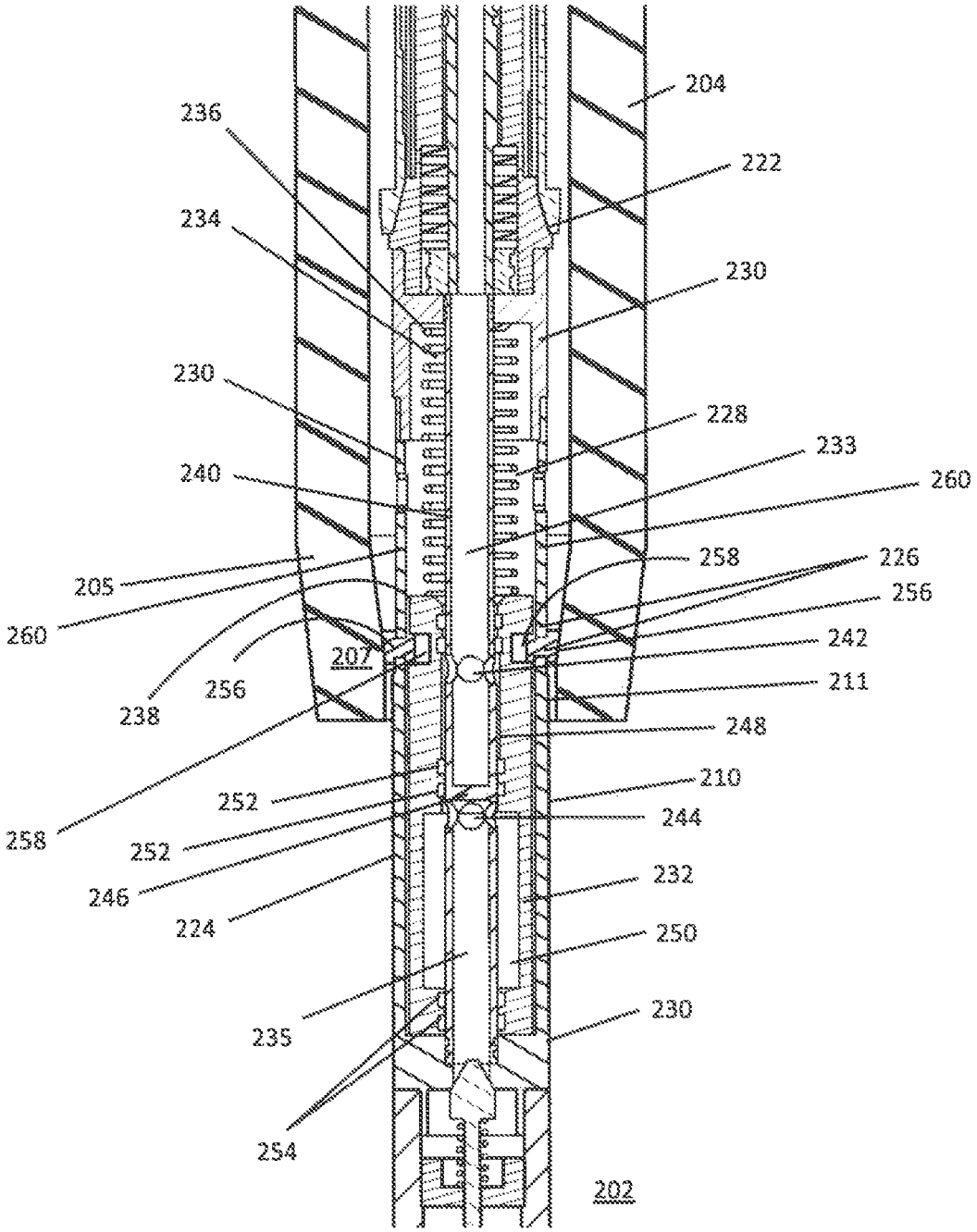
FIG. 4 is an enlarged portion of FIG. 3 showing a sliding valve arrangement of the support device of the invention in a closed position in which the valve is not open for passage of fluid.
Figure 6:
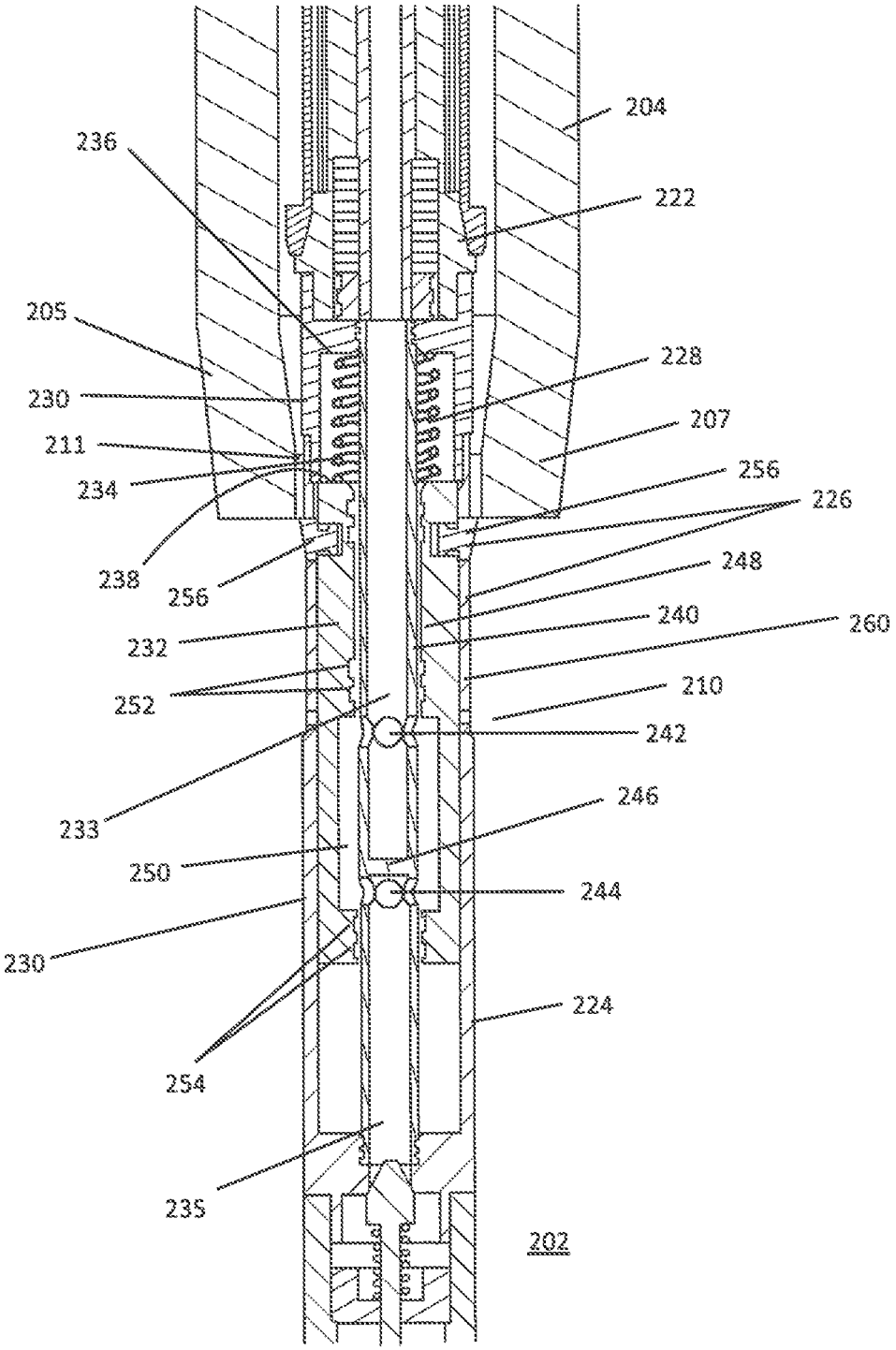
FIG. 6 is a schematic cross-sectional elevation of the sliding valve of support device of the present invention in an open position allowing passage of fluid through the valve.

Referring to FIGS. 4 and 6, the moving element 232 is movably mounted on a fluid conduit 240 having a through inner bore 235 (which forms part of the fluid passageway 233 of the inflation valve 224) and a pair of apertures in its side walls, an upper aperture 242 and a lower aperture 244. The apertures 242, 244 are spaced apart axially along the conduit 240 within the inflation valve 224. A partition 246 which blocks fluid passage through the inner bore 235 is disposed across the inner bore 235 of the conduit 240 between the apertures 242, 244. Fluid pressure is exerted on, is retained by and/or can build up against the partition 246 when the inflation valve 224 is shut, i.e. during the delivery of the support device 200 through the string 204 and prior to inflation of the inflatable element 206. The conduit 240 is received in a channel 248 formed in the moving element 232. A chamber 250 is formed within the moving element 232 communicating with the channel 248 and the conduit 240 is disposed in the channel 248 and crosses the chamber 250. The chamber 250 is configured to accommodate a length of the conduit 240 comprising both apertures 242, 244. When the inflation valve 224 is shut (i.e. when the outer sleeve 230 and the moving element 232 are biased away from each other by the biasing means 234 and the moving element 232 is in a first position within the outer sleeve 230), the upper aperture 242 of the conduit 240 is disposed within the channel 248 such that passage of fluid through the upper aperture 242 and, as a result, through the inflation valve 224, is prevented. When the inflation valve 224 is open (i.e. when the force of the biasing means 234 has been overcome by increasing the pressure of the fluid in the workstring 204 acting on the inflation valve 224, and, as a result, on the partition 246, so that the moving element 232 is moved into a second position within the outer sleeve 230), both apertures 242, 244 are located in the chamber 250 such that fluid can flow out of the conduit 240 through the upper aperture 242 into the chamber 250 and re-enter the conduit 240 at the other side of the partition 246 through the lower aperture 244. Fluid tight seals 252 are provided between an outer surface of the conduit 240 and an inner surface of the channel 248 in the moving element 232 so as to prevent fluid seeping from the conduit 240 into the chamber 250 when the inflation valve 224 is shut. A further set of fluid tight seals 254 prevents fluid from seeping outside of the chamber 250.

Figure 5:
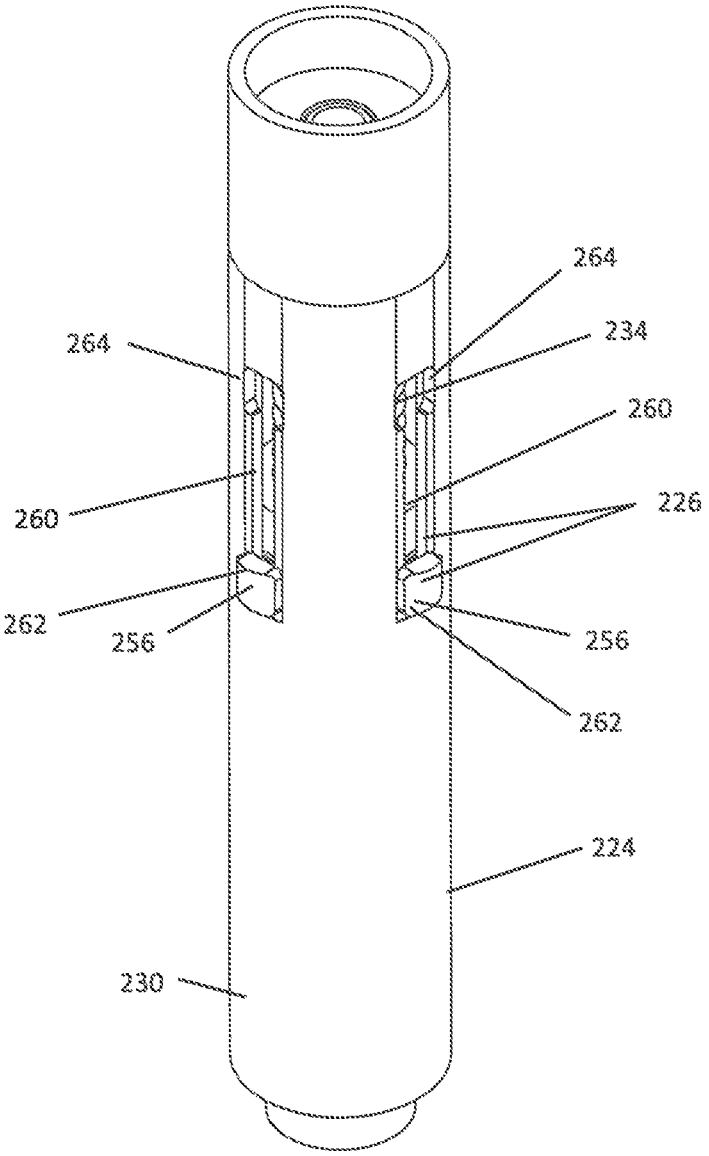
FIG. 5 is a schematic perspective view of a sliding valve of FIGS. 3 and 4 separately from the support device and the string.

As described above, the support device 200 is delivered to the bottom outlet (or exit) portion 205 of the string 204. As shown in FIGS. 3, 4 and 6 to 11, a coupling portion 207 is provided at the outlet portion 205 of the string 204. The coupling portion 207 may comprise a part of a landing sub 209 (FIGS. 3, 7 and 8). As the support device 200 reaches the coupling portion 207, the actuation means 226 automatically releasably engages a wall of an inner bore of the coupling portion 207 by four (two only are visible in the drawings) engaging elements 256 provided in the form of dogs in the presently described embodiment. The engaging elements 256 are mounted on the moving element 232 in corresponding recesses 258 provided in an outer surface of the moving element 232. The engaging elements 256 can move radially in and out of the recesses 258. When the moving element 232 is biased into the position shutting the inflation valve 224 each engaging element 256 is radially moved out in its corresponding recess 258 and protrudes laterally or radially from an outer surface of the outer sleeve 230 through a corresponding slot 260 (as best seen in FIGS. 4 and 5). Each engaging element 256 has an enlarged head 262 (FIG. 5) protruding from the outer face of the outer sleeve 230. The enlarged head 262 is wider than the slot 260 and therefore the engaging elements 256 are prevented from moving in as long as the outer sleeve 230 and the moving element 232 are biased away from each other by the biasing means 234 and the moving element 232 is in a first position within the outer sleeve 230 and the inflation valve 224 is shut. Thus, the engaging elements 256 automatically engage the coupling portion 207 when the support device 200 reaches the bottom outlet portion 205 of the string 204. The engaging elements 256 and an inner surface of the coupling portion 207 include corresponding tapering portions (not indicated by a numeral) which engage when the support device 200 reaches the coupling portion 207 and prevent the support device from slipping out through the outlet portion 205 of the string 204 into the wellbore 202. The engaging elements 256 continue to engage the coupling portion 207 as long as the inflation valve 224 remains shut thereby keeping the inflatable element 206 connected with the string 204 before the inflatable element 206 is inflated and can support itself in the wellbore 202. Moreover, the biasing means 234 further operates to prevent early, accidental or unwanted actuation of the support device 200 due to the dogs 256 for example hitting a tool joint on their travel through the workstring 204 throughbore. If such a collision occurs, the spring 234 acts to resist upward relative movement of the dogs 256 and furthermore returns the dogs 256 to their starting position (as shown in FIG. 4). Accordingly, the biasing means 234 help to ensure that the engaging elements 256 don't move into alignment with widened end portions 264 (as will be discussed subsequently) unless and until they have been held up by the tapered exit of coupling portion 207 and can therefore pass through the same (207) when such alignment (256 with 264) is desired and attained.

The actuation means 226 is configured to be activated by the string 204 when the predetermined pressure for overcoming the bias force of the biasing means 234 has been exceeded whereby the reaction force acting from the string 204 on the actuation means 226 causes relative displacement of the moving element 232 with respect to the outer sleeve 230 into the second position in which the fluid passageway 233 through the inflation valve 224 into the inflatable element 206 is open. For this purpose, the engaging elements 256 are movably arranged in the slots 260 of the outer sleeve 230. When the predetermined pressure acts on the moving element 232 forcing the moving element 232 in the downward direction, the reaction force of the coupling portion 207 exerts an upward force on the engaging elements 256 which is sufficient to cause the engaging elements 256 to move along the slots 260 ultimately moving the moving element 232 upwardly with respect to the outer sleeve 230 (FIG. 6) and compressing the biasing means 234 (the spring). Thus, the moving element 232 moves into the second position in which the apertures 242, 244 of the conduit 240 are both accommodated in the chamber 250 so that the inflation valve 224 is open for passage of fluid. The slots 260 include respective widened end portions 264 into which the enlarged heads 262 of the engaging elements 262 are pushed by a narrowed lower region 211 of the coupling portion 207 at the end of the travel of the moving element 232 into the second position. The engaging elements 262 are thus retracted into their respective recesses 258 in the moving element 232 but remain positioned in the widened end portions 264 of the slots 260 and thus cannot move along the slots 260 in the opposite direction. Corresponding engaging surfaces (not completely apparent from the drawings) are provided on the engaging elements 262 and on portions of the outer sleeve 230 defining the widened portions of the slots 260. The corresponding engaging surfaces engage when the engaging elements 262 move in and prevent the engaging elements 262 from moving out. Thus, the moving element 232 is locked in the second position and the inflation valve 224 is locked open for passage of fluid (FIG. 6).

The inflation valve 224 comprises an inflation control arrangement indicated generally by reference numeral 266 in FIGS. 7, 8 and 11. The inflation control arrangement 266 comprises a relief valve 268 (in the presently described embodiment comprising a rupture disc) provided at the inlet 208 of the inflatable element 206. The relief valve 268 connects the conduit 240 with a space outside the inflation valve 224 (e.g. an annular space or annulus between an exterior of the inflation valve 224 and the inner surface 214*a* of the wellbore wall 214 in which well fluid inhabits). The relief valve 268 is normally shut and is configured to open for passage of fluid at a predetermined pressure, the predetermined pressure being indicative of the inflatable element 206 having been fully inflated. The predetermined pressure is less, preferably, about 25% less, than a pressure required to cause the inflatable element 206 to burst (in the absence of the burst preventing outer sheath 216). When the relief valve 268 opens, fluid starts to flow into the space outside of the inflation valve 224 and, therefore, inflation of the inflatable element 206 stops. The flow of the fluid into the space external to the inflation valve 224 causes a pressure drop to be observed in the inflation valve 224 and in the string 204 through which the fluid is delivered. This provides an indication to an operator at the surface of the wellbore 202 that the inflatable element 206 has been fully inflated. Once the inflatable element 206 has been fully inflated it supports itself firmly in the wellbore 202 due to friction between the inflatable element 206 and the inner surface 214*a* of the wellbore wall 214. The so installed support device 200 is capable of supporting the weight of fluid, which is also a plug forming compound, delivered into the wellbore 202 above the support device 200. Accordingly, the inflatable element 206 can now be disconnected from the workstring 204 (as will be described below) and a barrier (plug) can be formed at this stage by dispensing the fluid from the outlet portion 205 of the string 204 into the wellbore 202 above the support device 200 while withdrawing the string 204 from the wellbore 202.

The inflation control arrangement 266 comprises a non-return inlet valve 270 at the inlet 208 of the inflatable element 206 preventing fluid from escaping from the inflatable element 206. In the presently described embodiment, the inlet valve 270 is a poppet valve. The inlet valve 270 is adapted to open at or above a predetermined hydraulic pressure differential between the hydraulic pressure inside the string 204 (i.e. outside of the inflatable element 206) and the hydraulic pressure inside the inflatable element 206. This provides the advantage that fluid can enter the inflatable element 206, but is prevented from flowing out of the inflatable element 206, so that the fluid pressure increases inside the inflatable element 206 thereby inflating and expanding the inflatable element towards the wall 214 of the wellbore 202, i.e. widthwise as well as along the tube 218, i.e. lengthwise (compare FIGS. 3, 7 and 8).

The inflation control arrangement 266 includes a non-return safety valve 272 (in the present embodiment provided in the form of a poppet valve) arranged upstream of the relief valve 268 and acting as a buffer between the conduit 240 and the relief valve 272 to prevent the relief valve 272 from damage due to a sudden pressure surge during activation of the inflation valve 224, i.e. during the opening of the inflation valve 224 for passage of fluid therethrough. The safety valve 272 allows the fluid to flow through the safety valve 272 towards the inflatable element 206 but prevents the fluid from flowing in the opposite direction.

The support device 200 comprises a burst preventing outer sheath 216 covering the inflatable element 206. In the presently described embodiment the sheath 216 is made from a pliable material which is also capable of withstanding high impact, such as, for example, Kevlar®, preferably a woven Kevlar®. It will be appreciated that the outer sheath 216 material may or may not be elastomeric. The outer sheath 216 material may be woven or non-woven. It will be appreciated that the invention is not limited to the use of Kevlar® and indeed other suitable materials (particularly those that are very strong in tension) will be apparent to a person skilled in the art. The outer sheath 216 is shaped so as to accommodate a fully inflated inflatable element 206. The size and shape of the outer sheath 216 when accommodating the inflatable element 206, which has been inflated to a predetermined fully inflated state, matches the size and shape of the so inflated inflatable element 206 (as shown in FIGS. 8 and 11). At the same time the outer sheath 216 is sized and shaped so that its outer diameter substantially matches an inner diameter of the wellbore 202 for which the support device 200 is designed (since wellbores differ in diameters, support devices 200 should ideally be provided in a range of sizes to suit specific wellbore diameters). In the presently described embodiment, the outer sheath 216 comprises a substantially cylindrical tube having a relatively constant diameter along its length. The outer sheath 216 is configured so as to prevent further inflation of the inflatable element 206 beyond is predetermined fully inflated state (as shown in FIGS. 8 and 11). The outer sheath 216 is wrapped or folded or tucked around the inflatable element 206 in the deflated state of the inflatable element 206 so that the outer sheath 216 gradually expands or unfolds as the inflatable element 206 is being inflated until the outer sheath 216 assumes its fully expanded or unfolded configuration (as shown in FIGS. 8 and 11). In the fully expanded configuration of the outer sheath 216 further inflation of the inflatable element 206 is not possible, but at the same time sufficient pressure is allowed to build up to activate the relief valve 268. Thus, the burst preventing outer sheath 216 provides a simple, reliable and inexpensive safety feature preventing the inflatable element 206 from overinflation and/or from an accidental burst.

Figure 9:
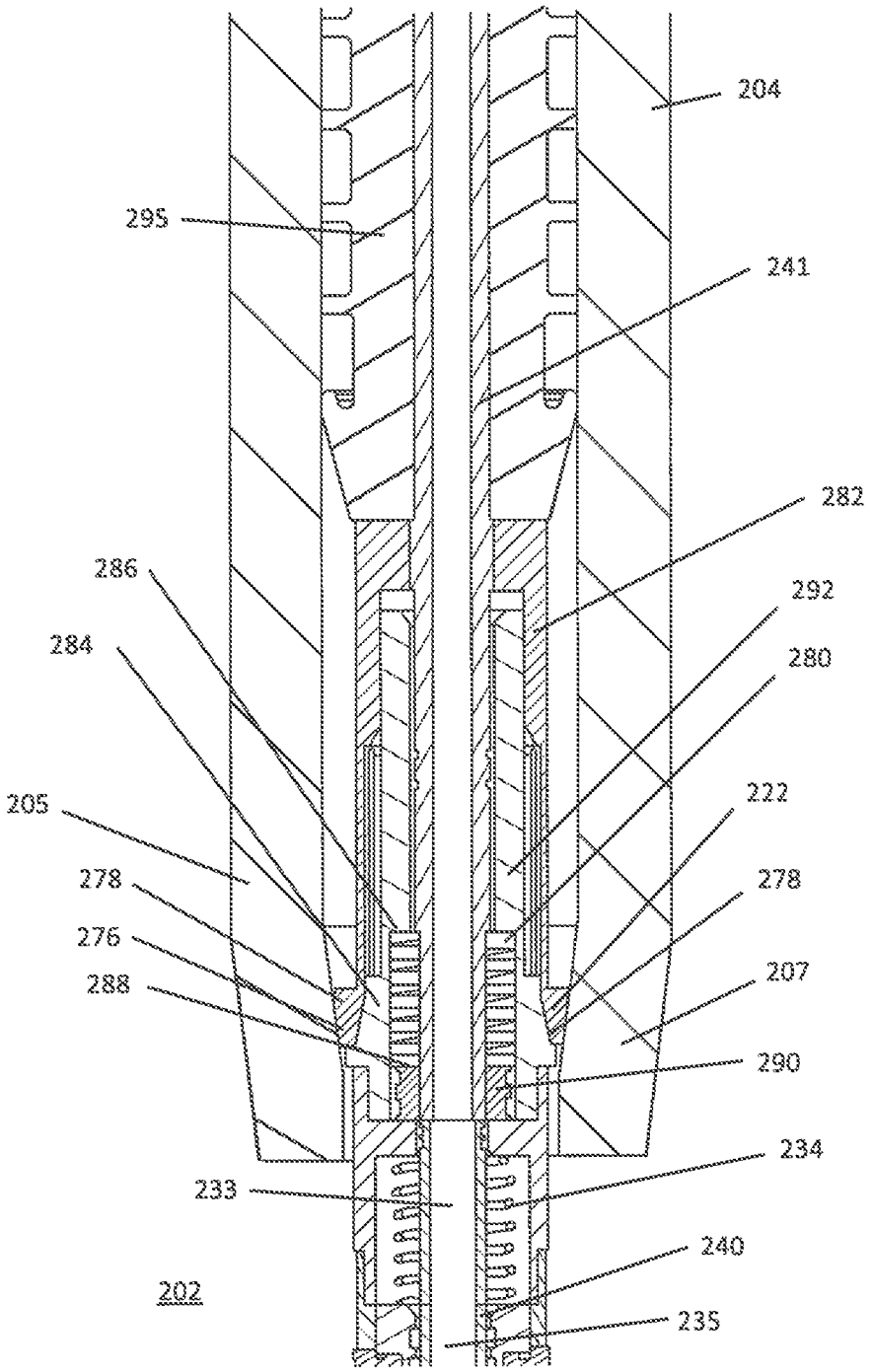
FIG. 9 is an enlarged portion of FIG. 8 showing a latch mechanism of the support device of the present invention engaged with an inner wall at the outlet portion of the string to keep the support device attached to the string.
Figure 10:
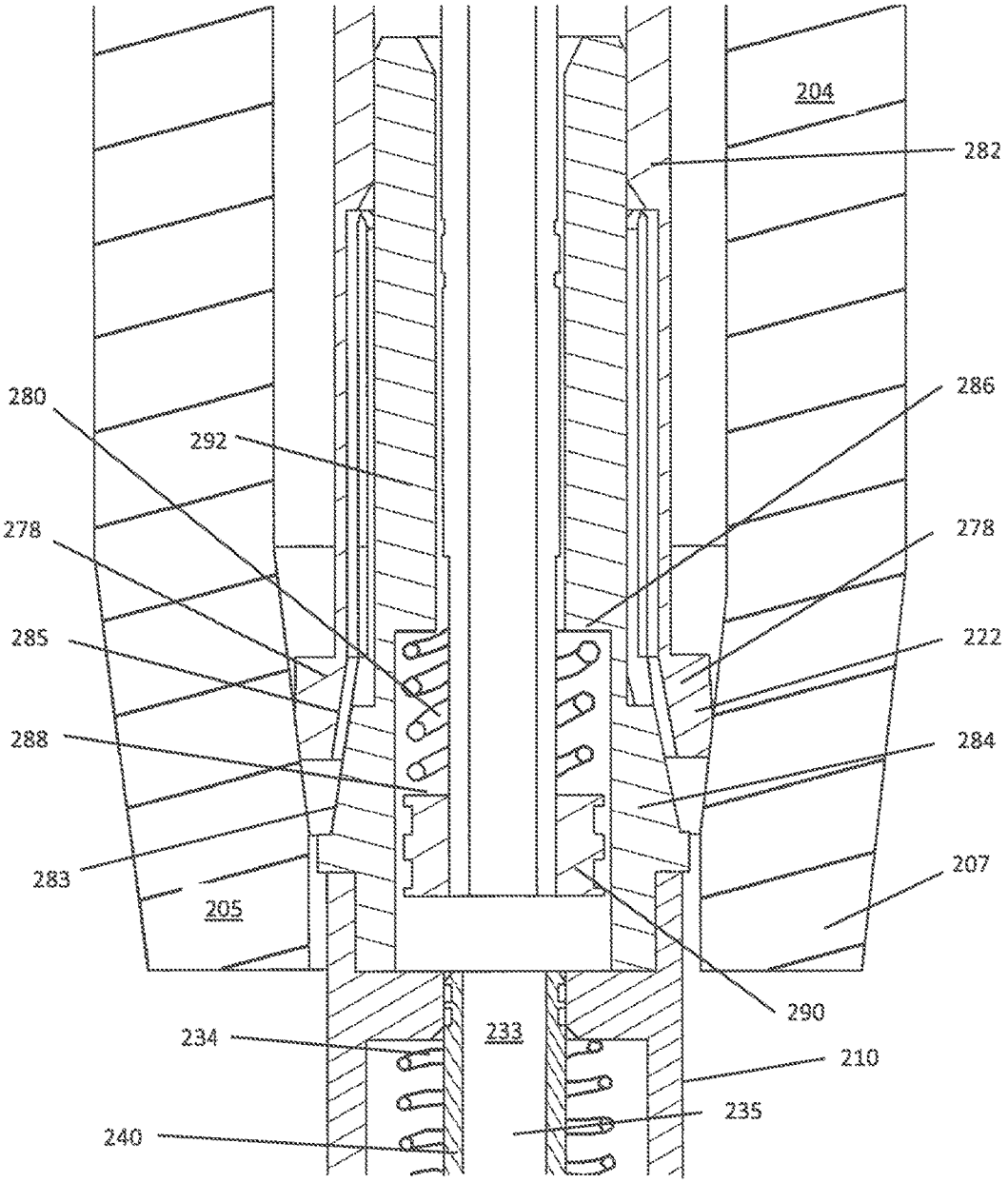
FIG. 10 is a schematic cross-sectional elevation showing the latch mechanism in the beginning of disengagement from the inner wall of the string.

Referring now to FIGS. 9 and 10, the disconnect mechanism 222 comprises a latch mechanism 276 which prevents the inflation valve 224 from disconnecting from the string 204 after the engaging elements 256 of the moving element 232 have been retracted into their respective recesses 258 in the moving element 232 and disconnected from the coupling portion 207 as well as after the inflatable element 206 is being inflated. The latch mechanism 276 is arranged to disengage from the string 204 when the inflatable element 206 has been inflated and securely positioned across the wellbore 202 by pulling the string 204 from surface. The latch mechanism 276 comprises engaging elements 278 provided on the form of resilient fingers of a collet in the presently described embodiment. The engaging elements 278 protrude laterally or radially relative to the outer surface of the outer sleeve 230 in a latching position to engage the inner surface of the coupling portion 207. The engaging elements 278 of the latch mechanism 276 are biased into the latching position by a bias means in the presently described embodiment provided in the form of a spring 280 of the latch mechanism 276. The engaging elements 276 are provided on a mandrel 282 which is connected to an upper part 241 of the conduit 240. The upper part 241 of the conduit 240 is connected to the string 204 via an adaptor 295 and is separable from a lower part of the conduit 240 below the latch mechanism 276. An end portion 284 of the inflation valve 224 is received in the mandrel 282. The engaging elements 278 and the end portion 284 of the inflation valve 224 include cooperating tapering surfaces 285, 283 respectively. The spring 280 is disposed between an inner downwardly facing end face 286 of the end portion 284 of the inflation valve 224 and an upwardly facing face of a stop member 290 provided at a lower end of the upper part 241 of the conduit 240. Thus, the spring 280 biases the mandrel 282 and the end portion 284 of the inflation valve 224 towards each other such that the respective cooperating tapering surfaces 285, 283 of the engaging elements 278 and the end portion 284 of the inflation valve 224 are wedged against each other thereby holding the engaging elements 278 in the protruding positions. When the inflatable element 206 has been inflated and secured in the wellbore 202 and it is necessary to disengage the support device 200 from the string 204, the bias force of the spring 280 is overcome by pulling the string 204 from surface. By doing this, the spring is compressed between the end face 286 of the end portion 284 of the inflation valve 224 and the upwardly facing face 288 of the stock member 290 so that the engaging elements 278 of mandrel 282 move axially upwardly away from the end portion 284 of the inflation valve 224. The end portion 284 of the inflation valve 224 has a region 292 of a reduced diameter provided above the tapered surfaces 283 and the engaging elements 278, once disengaged from the tapering surfaces 283, snap radially inwardly onto the region 292 and thereby allow the mandrel 282 to pass through the an open end of the coupling 207. Increase in the fluid pressure in the string 204 may be required to push the adaptor 295 down along the string 204. As a result, the entire support device 200 disengages from the string 204 (see FIG. 11) as the inflation valve 224 no longer holds the engaging elements 278 of the mandrel 282 in the protruding position. Preferably, the latch mechanism 276 is adapted to allow fluid to flow between the string 204 and the inflation valve 224. Alternatively, the latch mechanism 276 can be disengaged from the string 204 by applying more pressure to the inflation valve 224. The latter method is preferably employed as a contingency release method in case the support device 200 fails for any reason, such as failure of the inflatable element 206 or of the relief valve 268. In case of failure of the relief valve 268 (not indicated by a numeral), a through aperture of the relief valve 268 is small compared to the internal diameter of the fluid passageway 233 of the inflation valve 224 such that if the relief valve 268 opens too early increase in fluid pressure in the string 204 will result in a sufficient pressure acting on the disconnect mechanism 222 to release the support device 200 from the string 204. It will be appreciated that the above described latch mechanism 276 is not limited to the use with the support device 200 of the present invention and indeed can find use in disconnecting other devices (e.g. perforation guns) from a workstring down hole.

Figure 12:
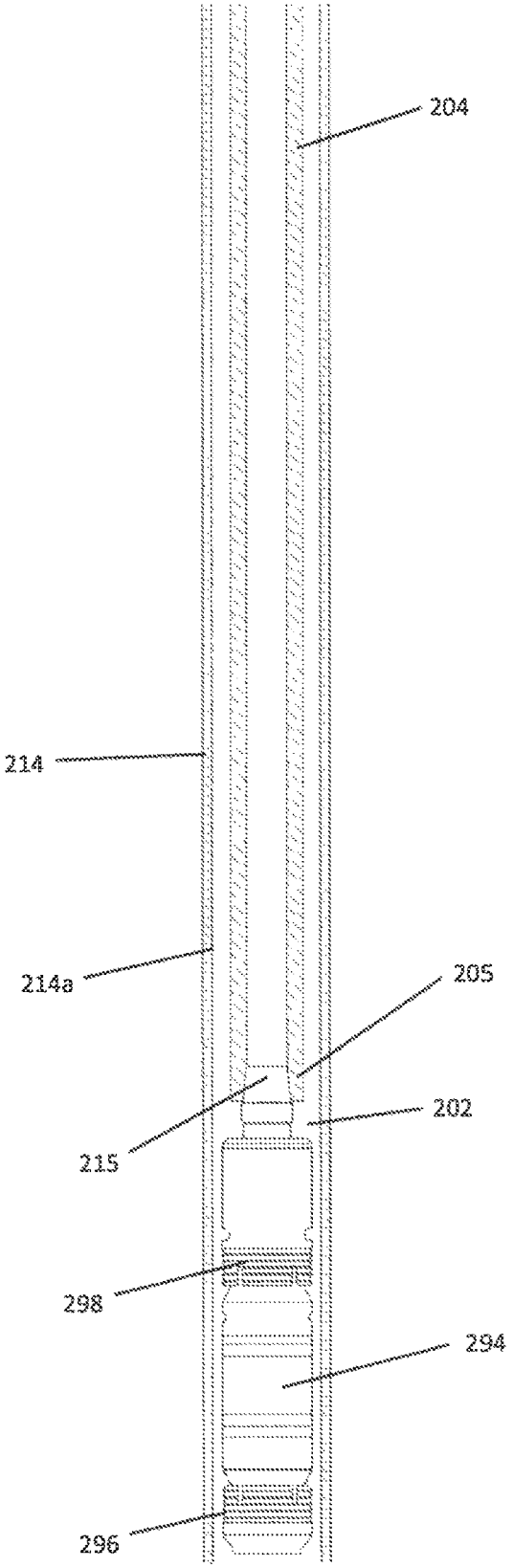
FIG. 12 is a schematic cross-sectional elevation of a string having a bridge plug attached thereto via an open ended coupling.
Figure 13:
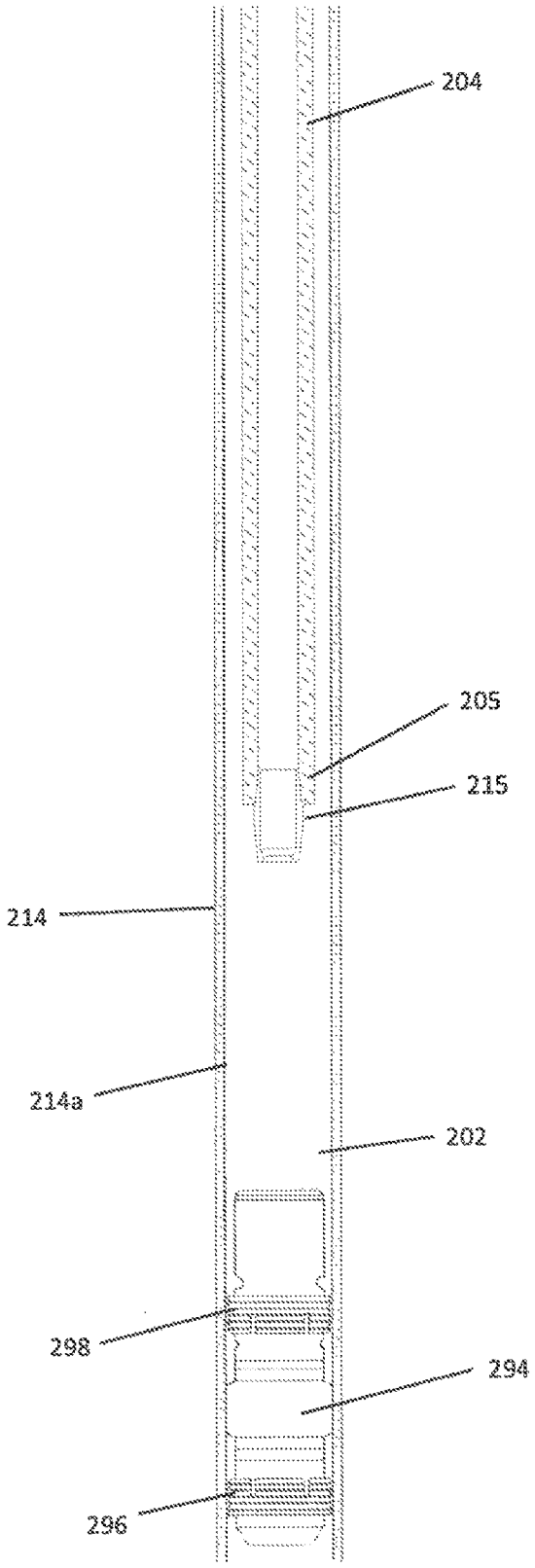
FIG. 13 is a schematic cross-sectional elevation of the bridge plug of FIG. 12 having been disconnected from the string and installed at a location on a wellbore.
Figure 14:
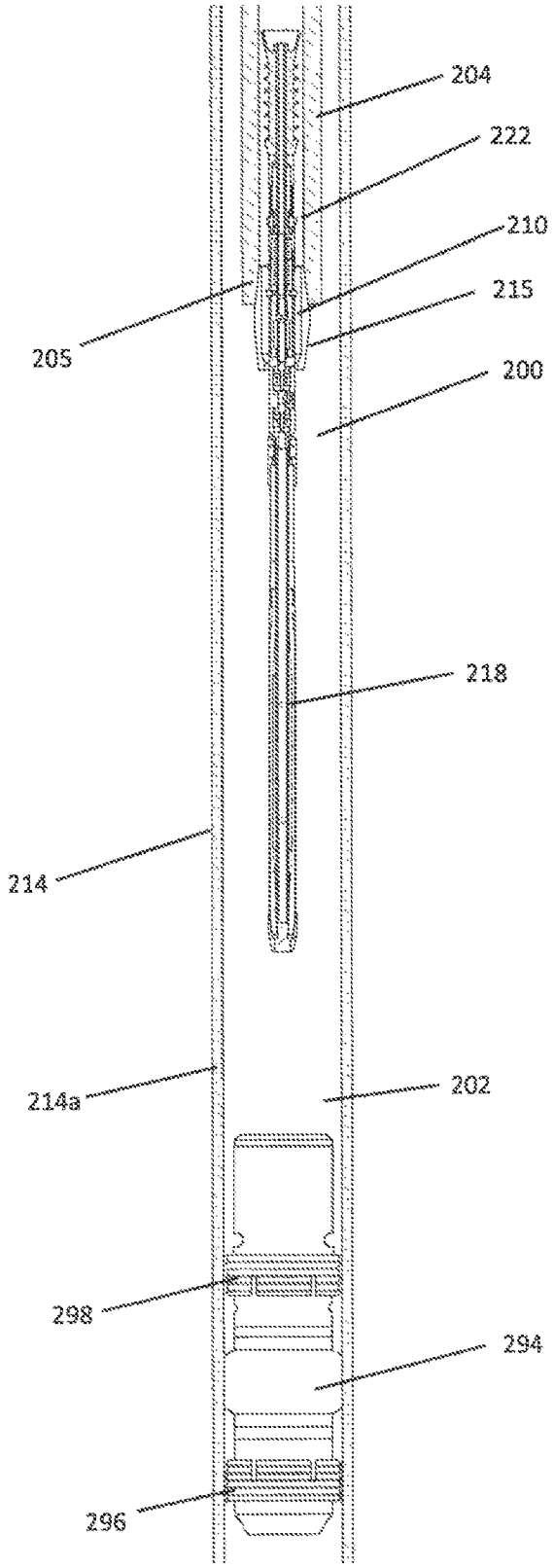
FIG. 14 is a schematic cross-sectional elevation of the string of FIGS. 12 and 13 having a support tool of the present invention attached thereto via the open ended coupling.

Referring to FIGS. 12 to 14, in an alternative arrangement, a coupling portion of the string 204 comprises an open ended end coupling 215 couplable to a distal (in use lower most) end of the string 204 and adapted to be coupled with a bridge plug 294. With the method of deploying the support device 200 of the present invention, it is possible to (alternatively or in addition to deploying the inflatable support tool 200) deploy a bridge plug 294 to a desired location downhole using the same string 204 as for deploying the inflatable support tool 200. This is particularly advantageous when it is necessary to isolate a section of a wellbore 202 using a bridge plug 294 or other required primary barrier (not shown) rather than an inflatable support device 200 (which may be the case in order to comply with certain regulations or for any other reason. In this case, the bridge plug 294 attached to the distal end of the string 204 via the end coupling 215 can be first delivered to a desired location in the wellbore 202, secured in place and then disconnected from the string 204. The bridge plug 294 may be released from the string 204 in a suitable manner, for example, by a combination of hydraulic and mechanical actions. For example, by dropping an object (not shown), such as a ball down the string 204, flow of fluid through the string 204 can be obstructed thereby activating a first set 298 of engaging members on the bridge plug 294 and causing the first set 298 of engaging members to engage the inner wall 214 of the wellbore 202. By overpulling the string 204, a second set 296 of engaging members can be activated to engage the wall 214 of the wellbore 202. Once the bridge plug 294 has been set in place, the bridge plug 294 can be disconnected from the string 204 and from the end coupling 215 by rotating the string 204 (FIG. 13). The wellbore 202 can then be plugged above the bridge plug 294 by delivering the fluid such as cement through the string 294, eliminating the need for a second run out of and then back into the wellbore 202 to deliver the fluid on top of the bridge plug 294. Once a sufficient amount of fluid (not shown) has been delivered into the wellbore 202 above the bridge plug 294, the string 204 is partially pulled out of hole by a certain length (e.g. 500 m) until the end coupling 215 is at the location that the operator would like to place a second column of cement in the wellbore 202. At this point, a support tool 200 of the present invention is deployed from surface through the same string 204 and inflated as hereinbefore described in accordance with the present invention, and without the need for a separate run (FIG. 14). Since the same string 204 and the same end coupling 215 are used to deliver the bridge plug 294 and to deploy the support device 200, one bridge plug 294 and multiple support devices 200 can be delivered on the same string 204 allowing the wellbore 202 to be plugged at several zones and only requiring one trip into the well and one trip out, thus saving considerable rig time.

The support device 200 of the present invention provides a superior inflation valve which ensures that inflation is initiated only when the support device 200 reaches a particular position in the wellbore (e.g. a bottom end of the string 204) and not while the support device 200 is being manoeuvred through the string 204. Furthermore, the inflation control arrangement of the inflation valve 224 firstly prevents the inflatable element 206 from bursting and at the same time serves as a signal means to an operator at the surface of the wellbore 202 that the inflatable element 206 has been inflated and that it can be disconnected from the workstring 204 so that the wellbore 202 above the support device 200 can be plugged with a plugging compound, such as cement which has been already delivered to the bottom end of the string 204 while delivering the support device 200.

The workstring 204 may be any one of a string of tubulars such as a drill pipe string or a coiled tubing string or production tubing string or could be a slickline or wireline if a suitable fluid reservoir or chamber were also provided to deliver the required volume of pressurised fluid required to inflate the inflatable element 206 when desired or required. More preferably, the workstring comprises one of a string of tubulars that comprises a throughbore through which the device 200 is conveyed and which can preferably be run into or pulled out of the borehole or wellbore where the borehole may be an open borehole or where the wellbore may be cased or lined with a casing or liner string such as a drill pipe string or a coiled tubing string. Alternatively, the string of tubulars may be a liner or casing string.

The support device 200 of the present invention provides the advantage that a wellbore barrier (plug) can be placed and sufficiently secured anywhere within the wellbore 202, either permanently or temporarily, using a dedicated displacement fluid utilized within the wellbore 202. For example, the displacement fluid may be cement slurry or an elastomeric compound, such as a resin. It will however be appreciated that any other suitable flowing substance (e.g. such as fluid, fluidized solids, granular and powdery matters) can be used.

The support device 200 of the present invention eliminates the need for a specific run to deploy the support device 200 downhole as both the deployment of the support device and plugging the wellbore 202 are completed using the same string 204 of tubulars without the need to withdraw the string 204 prior to cementing.

Moreover, the support device 200 and the fluid used to plug the wellbore 202 are delivered downhole simultaneously and therefore there is no need to deliver fluid in a separate subsequent operation. The support device 200 of the present invention provides a very reliable mechanism for creating a barrier or plug that is adapted to not only support, for example, a cement slurry placed on top of the support device 200, but also to sufficiently seal off the wellbore 202 in order to prevent contamination of the wellbore section below the support device 202 during operation. The support device 200 of the present invention provides for safe and reliable inflation, reduces the risk of failure and safe and timely disconnection of the support device 200 from the string 204.

In addition, the support device 200 of the present invention provides the advantage that the strength of the support device 200 can be tested during installation, thus, minimizing the risk of potential damage during inflation and/or structural failure of the support device 200 when placing the fluid on top of the support device 200.

Also, delivering and securing the support device 200 and delivering the fluid down hole, such as cement material, used within the wellbore is carried out simultaneously, minimizing time and costs needed for deployment and subsequent constructive work inside the wellbore 202. Furthermore, since the same string 204 is used to deliver the support device 200 and the fluid, multiple support devices 200 can be delivered on the same string 204 allowing the wellbore 202 to be plugged at several zones. Furthermore, because the inflatable element 206 of the support device 200 can be delivered to the predetermined location inside the wellbore 202 in its deflated state, no further packaging or diameter reducing arrangement of the support device 200 is necessary. Furthermore, a plurality of successively launched support devices 200 with respective columns of fluid used for plugging can be pumped through the string 204 from surface as the string 204 is pulled out of the wellbore 202 such that an inflatable support tool 200 is inflated and disconnected from the string 204 at a desired location such as just above each respective zone in the wellbore 202 thereby permitting a wellbore 202 to be abandoned in one trip out of the wellbore 202.

The specifically designed actuation mechanism 226 allows the support device 200 to be automatically secured at the outlet portion 205 of the string 204 of tubulars such that the inflatable element 206 is operatively located at the predetermined location of the wellbore 202, further allowing a seamless positioning, inflation, and deployment of the support device 200 without any unnecessary steps having to be undertaken by the operator.

The disconnect mechanism 222 prevents the support device 200 from uncontrolled disconnection after the inflation valve 224 has been opened for passage of fluid as well as after the inflatable element 206 has been inflated and allows an operator to time the disconnection of the support device 200 from the string 204 according to the particular circumstances of the deployment operation.

The inflatable element 206 may comprise an additive adapted to accelerate the hardening process of the fluid received in the inflatable element 206. This provides the advantage that the support device 200 provides a secure and reliable support before further fluid is deposited on top of the support device 200, thereby minimizing the risk of the additional load compromising the structural integrity of the support device 200.

The support device 200 of the invention provides sufficient support during the formation of a wellbore structure such as a wellbore compound plug or during a casing cementing operation, wherein the support device 200 can either be integrated permanently with the plug, or temporarily installed for the duration of a casing cementing operation in a section of the wellbore 202. Furthermore, during the formation of the wellbore structure, the fluid is prevented from slumping into the space below the support device 200, therefore minimizing possible contamination.

It will be appreciated by persons skilled in the art that the above embodiments have been described by way of example only and not in any limitative sense, and that various alterations and modifications are possible without departing from the scope of the invention.

The invention claimed is:

1. A downhole support device for use in a wellbore and adapted to be run into the wellbore through a workstring, the downhole support device comprising:

an inflatable element adapted to be selectively connectable to the workstring and to apply a biasing force to an external structure in an inflated state, the inflatable element having an inlet for receiving and being inflated by a fluid;

an inflation mechanism comprising an inflation valve arrangement in fluid communication with the inlet of the inflatable element, the inflation valve arrangement comprising an actuation means adapted to actuate the inflation valve arrangement at a predetermined pressure acting on the inflation valve arrangement to enable inflation of the inflatable element; and a disconnect mechanism adapted to be selectively disconnectable from the workstring;

wherein the disconnect mechanism comprises a latch mechanism which prevents the inflation valve arrangement from disconnecting from the string when the inflatable element is being inflated;

wherein the latch mechanism comprises one or more first engaging elements which protrude laterally from the outer surface of the inflation valve arrangement in a latching position to engage an inner surface of the workstring, wherein, in a release mode, the one or more first engaging elements are capable of being withdrawn inwardly towards a central axis of the inflation valve arrangement by lifting the workstring once the inflatable element has been inflated, such that the inflation valve arrangement is released from the workstring.

2. The device of claim 1, wherein the inflation valve arrangement further comprises a locking mechanism keeping the inflation valve arrangement in a first shut position until the predetermined pressure has been reached.

3. The device of claim 2, wherein the inflation valve arrangement comprises at least one moving element and the locking mechanism comprises a biasing means arranged to bias the moving element of the inflation valve arrangement into the first shut position blocking a fluid passageway through the inflation valve arrangement into the inflatable element.

4. The device of claim 3, wherein the actuation means is configured to releasably engage the inner surface of the workstring whilst the moving element of the inflation valve arrangement is biased by the biasing means into the first shut position thereby keeping the inflatable element connected with the workstring before the inflatable element is inflated and can support itself in the wellbore.

5. The device of claim 3, wherein the moving element of the inflation valve arrangement comprises a sliding valve.

6. The device of claim 3, wherein the inflation valve arrangement further comprises a relief valve provided at the inlet of the inflatable element, the relief valve connecting the fluid passageway with a space outside the inflation valve arrangement.

7. The device of claim 1, wherein the actuation means is configured to releasably engage the inner surface of the workstring by one or more second engaging elements, the one or more second engaging elements protruding laterally from an outer surface of the inflation valve arrangement when a fluid passageway through the inflation valve arrangement is blocked.

8. The device of claim 7, wherein the one or more second engaging elements comprise one or more dogs movable in respective slots provided in the outer surface of the inflation valve arrangement and being retractable or collapsible into respective recesses in the outer surface of the inflation valve arrangement.

9. The device of claim 1, further comprising a burst preventing outer sheath covering the inflatable element.

10. The device of claim 1, further comprising a non-return valve at the inlet of the inflatable element preventing fluid from escaping from the inflatable element.

11. The downhole support device according to claim 1, wherein the downhole support device is adapted to be run into the wellbore to a pre-determined location by pumping the downhole support device through a throughbore of the work string which is already located within the wellbore until the downhole support device is secured at an outlet portion of the elongate member string such that the downhole support device is operatively located at the predetermined location of the wellbore.

12. A downhole support device for use in a wellbore and adapted to be run into the wellbore through a workstring, the downhole support device comprising:

an inflatable element adapted to be selectively connectable to the workstring and to apply a biasing force to an external structure in an inflated state, the inflatable element having an inlet for receiving and being inflated by a fluid;

an inflation mechanism; and a disconnect mechanism adapted to be selectively disconnectable from the workstring;

wherein the inflation mechanism comprises an inflation valve arrangement in fluid communication with the inlet of the inflatable element, the inflation valve arrangement comprising an actuation means adapted to actuate the inflation valve arrangement at a predetermined pressure acting on the inflation valve arrangement to enable inflation of the inflatable element;

wherein the inflation valve arrangement further comprises a locking mechanism that blocks a fluid passageway through the inflation valve arrangement until the predetermined pressure has been reached;

wherein the inflation valve arrangement comprises at least one moving element and the locking mechanism comprises a biasing means arranged to bias the moving element of the inflation valve arrangement into a first position blocking the fluid passageway through the inflation valve arrangement into the inflatable element;

wherein the inflation valve arrangement further comprises a relief valve provided at the inlet of the inflatable element, the relief valve connecting the fluid passageway with a space outside the inflation valve arrangement; and further comprising a safety valve arranged to act as a buffer between the fluid passageway and the relief valve to prevent the relief valve from damage due to a sudden pressure surge during activation of the inflation valve arrangement.

13. The device of claim 12 further comprising a non-return valve at the inlet of the inflatable element preventing fluid from escaping from the inflatable element.

14. The device of claim 12, wherein the disconnect mechanism comprises a latch mechanism which prevents the inflation valve arrangement from disconnecting from the workstring when the inflatable element is being inflated.

15. The device of claim 14 wherein the latch mechanism comprises one or more first engaging elements which protrude laterally from the outer surface of the inflation valve arrangement in a latching position to engage an inner surface of the workstring and are withdrawn inwardly towards a central axis of the inflation valve arrangement in a release mode, such that the inflation valve arrangement is released from the workstring.

16. The device of claim 12 wherein the actuation means is configured to releasably engage an inner surface of the workstring by one or more second engaging elements, the one or more second engaging elements protruding laterally from an outer surface of the inflation valve arrangement when the inflation valve arrangement is shut.

17. The downhole support device according to claim 12, wherein the downhole support device is adapted to be run into the wellbore to a pre-determined location by pumping the downhole support device through a throughbore of the work string which is already located within the wellbore until the downhole support device is secured at an outlet portion of the elongate member string such that the downhole support device is operatively located at the predetermined location of the wellbore.

18. A method for deploying a barrier in a wellbore, the method comprising the steps of:

(a) providing and securing a downhole support device in accordance with any preceding claim at a bottom outlet of the said workstring, such that the inflatable element of the support device is positioned outside said workstring at a predetermined location inside the wellbore (b) inflating said inflatable element with the said fluid through said bottom outlet of the workstring, into a sealing engagement with the wellbore;

(c) detaching the support device from said workstring;

(d) and permitting said fluid in said workstring to flow through said bottom outlet of the workstring into a space of the wellbore above said downhole support device; and (e) delivering an amount of fluid through said bottom outlet of the workstring on top of said secured downhole support device.

19. The method of claim 18, further comprising the step of:

(f) allowing the said fluid to harden, thereby defining a compound plug in the wellbore.

20. The method of claim 18, wherein step (c) is initiated by providing a predetermined hydraulic pressure at said bottom outlet of the workstring or by pulling the string upwardly from surface.

21. The method of claim 18, further comprising the step of actuating the inflation valve arrangement when a predetermined fluid pressure is acting on the inflation valve arrangement to enable inflation of the inflatable element.

22. The method of claim 18, further comprising the step of delivering the support device to said bottom outlet of the workstring by pumping fluid through the workstring and thus causing the support device to advance along the string.

23. A downhole support device for use in a wellbore and adapted to be run into the wellbore through a workstring; the downhole support device comprising:

an inflatable element adapted to be selectively connectable to the workstring and to apply a biasing force to an external structure in an inflated state, the inflatable element having an inlet for receiving and being inflated by a fluid;

an inflation mechanism; and a disconnect mechanism adapted to be selectively disconnectable from the workstring;

wherein the inflation mechanism comprises an inflation valve arrangement in fluid communication with the inlet of the inflatable element, the inflation valve arrangement comprising an actuation means adapted to actuate the inflation valve arrangement at a predetermined pressure acting on the inflation valve arrangement to enable inflation of the inflatable element wherein the actuation means is configured to releasably engage an inner surface of the workstring by one or more engaging elements, the one or more engaging elements protruding laterally from an outer surface of the inflation valve arrangement when the inflation valve arrangement is shut;

wherein the one or more engaging elements comprises one or more dogs movable in respective slots provided in the outer surface of the inflation valve arrangement and being retractable or collapsible into respective recesses in the outer surface of the inflation valve arrangement; wherein the inflation valve arrangement is only permitted to open once the said one or more dogs have moved along their respective slot and have retracted or collapsed into their respective recess in the outer surface of the inflation valve arrangement.

24. A method for deploying a barrier in a wellbore, according to claim 18, wherein prior to step (a) the method comprises the steps of:

(i) pumping the downhole support device into the wellbore down through the throughbore of the workstring such that it is run into the wellbore through the throughbore of the workstring until the disconnect member is secured at the bottom outlet against a corresponding surface at the bottom outlet of the workstring, such that said inflatable element is positioned below said workstring at a predetermined location inside the wellbore; and wherein step (b) further comprises:—

(ii) inflating said inflatable element by pumping said fluid from the workstring and into said inflatable element through an inlet of said downhole support device, such that the inflatable element is expanded into sealing engagement with the wellbore walls;

and wherein step (c) further comprises:— iii) activating the disconnect member such that the downhole support device is disconnected from the outlet portion of the workstring.

25. A method for deploying a barrier in a wellbore, the method comprising the steps of:

(a) providing and securing a downhole support device in accordance with claim 23 at a bottom outlet of the said workstring, such that the inflatable element of the support device is positioned outside said workstring at a predetermined location inside the wellbore;

(b) inflating said inflatable element with the said fluid through said bottom outlet of the workstring, into a sealing engagement with the wellbore;

(e) detaching the support device from said workstring;

(d) and permitting said fluid in said workstring to flow through said bottom outlet of the workstring into a space of the wellbore above said downhole support device; and (e) delivering an amount of fluid through said bottom outlet of the workstring on top of said secured downhole support device.

26. A method for deploying a barrier in a wellbore according to claim 25, wherein prior to step (a) the method comprises the steps of:

(i) pumping the downhole support device into the wellbore down through the throughbore of the workstring such that it is run into the wellbore through the throughbore of the workstring until the disconnect member is secured at the bottom outlet against a corresponding surface at the bottom outlet of the workstring, such that said inflatable element is positioned below said workstring at a predetermined location inside the wellbore.

* * * * *